US009938480B2

(12) United States Patent
Baustian et al.

(10) Patent No.: US 9,938,480 B2
(45) **Date of Patent: *Apr. 10, 2018**

(54) BUTANOL COMPOSITIONS FOR FUEL BLENDING AND METHODS FOR THE PRODUCTION THEREOF

(71) Applicant: BUTAMAX ADVANCED BIOFUELS LLC, Wilmington, DE (US)

(72) Inventors: James J. Baustian, St. Charles, IL (US); Leslie Raymond Wolf, Naperville, IL (US)

(73) Assignee: Butamax Advanced Biofuels LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/156,490

(22) Filed: May 17, 2016

(65) Prior Publication Data

US 2016/0257900 A1 Sep. 8, 2016

Related U.S. Application Data

(60) Continuation of application No. 14/598,569, filed on Jan. 16, 2015, now Pat. No. 9,359,568, which is a (Continued)

(51) Int. Cl.
*C10L 10/14* (2006.01)
*C10L 1/02* (2006.01)
(Continued)

(52) U.S. Cl.
CPC ..... *C10L 10/14* (2013.01); *C10L 1/023* (2013.01); *C10L 1/14* (2013.01); *C10L 1/16* (2013.01); *C10L 1/1608* (2013.01); *C10L 1/1616* (2013.01); *C10L 1/1824* (2013.01); *C10L 1/1832* (2013.01); *C10L 10/10* (2013.01); *C10G 2300/305* (2013.01); *C10G 2400/02* (2013.01); *C10L 1/1691* (2013.01); (Continued)

(58) Field of Classification Search
CPC ..... C10L 1/1824; C10L 1/023; C10L 1/1608; C10L 1/1616; C10L 1/14; C10L 10/10; C10L 1/1691
See application file for complete search history.

(56) References Cited

U.S. PATENT DOCUMENTS 4,541,836 A 9/1985 Derderian
5,288,393 A 2/1994 Jessup et al.
(Continued)

FOREIGN PATENT DOCUMENTS

DE 102008008818 8/2009
WO WO200153437 7/2001
WO WO2009137356 11/2009

OTHER PUBLICATIONS

International Search Report for corresponding International Application No. PCT/US2012/051397, dated Jan. 18, 2013.

*Primary Examiner* — Cephia D Toomer

(57) ABSTRACT

The invention relates to butanol compositions for fuel blending and fuel blends comprising such compositions. The compositions and fuel blends of the invention have desirable performance characteristics and can serve as alternatives to ethanol-containing fuel blends. The invention also relates to methods for producing such butanol compositions and fuel blends.

16 Claims, 5 Drawing Sheets

Related U.S. Application Data division of application No. 13/243,569, filed on Sep. 23, 2011, now Pat. No. 8,968,429.

(51) Int. Cl.

| | |
|---|---|
| ***C10L 1/16*** | (2006.01) |
| ***C10L 1/182*** | (2006.01) |
| ***C10L 1/14*** | (2006.01) |
| ***C10L 10/10*** | (2006.01) |
| ***C10L 1/183*** | (2006.01) |

(52) U.S. Cl.

CPC ..... *C10L 2200/0415* (2013.01); *C10L 2200/0423* (2013.01); *C10L 2200/0492* (2013.01); *C10L 2230/22* (2013.01); *C10L 2270/023* (2013.01); *C10L 2290/24* (2013.01); *C10L 2300/20* (2013.01); *C10L 2300/30* (2013.01)

(56) References Cited

U.S. PATENT DOCUMENTS

| | | | |
|---|---|---|---|
| 5,593,567 | A | 1/1997 | Jessup et al. |
| 5,653,866 | A | 8/1997 | Jessup et al. |
| 5,837,126 | A | 11/1998 | Jessup et al. |
| 6,030,521 | A | 2/2000 | Jessup et al. |
| 7,323,020 | B2 | 1/2008 | Hull et al. |
| 8,465,560 | B1 | 6/2013 | Wolf |
| 8,734,543 | B2 | 5/2014 | Baustian |
| 8,968,429 | B2 | 3/2015 | Baustian et al. |
| 9,359,568 | B2 * | 6/2016 | Baustian ..... C10L 1/023 |
| 2006/0162243 | A1 | 7/2006 | Wolf |
| 2009/0099401 | A1 | 4/2009 | D'Amore et al. |
| 2009/0193711 | A1 | 8/2009 | Clark et al. |
| 2009/0199464 | A1 | 8/2009 | Wolf |
| 2009/0292512 | A1 | 11/2009 | Wolf |
| 2010/0307053 | A1 | 12/2010 | Kuberka et al. |
| 2011/0023354 | A1 | 2/2011 | Wolf |
| 2011/0283604 | A1 | 11/2011 | Foster et al. |
| 2012/0144902 | A1 | 6/2012 | Torres-Ordonez et al. |
| 2012/0151996 | A1 | 6/2012 | Baustian et al. |
| 2012/0240454 | A1 | 9/2012 | Boyd et al. |
| 2013/0180164 | A1 | 7/2013 | Wolf |
| 2013/0227878 | A1 | 9/2013 | Wolf |
| 2013/0247453 | A1 | 9/2013 | Baustian et al. |
| 2014/0005443 | A1 | 1/2014 | D'Amore et al. |
| 2014/0109467 | A1 | 4/2014 | Wolf |
| 2015/0128486 | A1 | 5/2015 | Baustian et al. |

* cited by examiner

BUTANOL COMPOSITIONS FOR FUEL BLENDING AND METHODS FOR THE PRODUCTION THEREOF

This application is a continuation of U.S. patent application Ser. No. 14/598,569, filed on Jan. 16, 2015, now U.S. Pat. No. 9,359,568 which is a divisional of U.S. patent application Ser. No. 13/243,569, filed on Sep. 23, 2011, now U.S. Pat. No. 8,968,429; the entire contents of which are all herein incorporated by reference.

FIELD OF THE INVENTION

The present invention relates to butanol compositions for fuel blending and fuel blends comprising such compositions. The compositions and fuel blends of the invention have desirable performance characteristics and can serve as alternatives to ethanol-containing fuels. The present invention also relates to methods for producing such butanol compositions and fuel blends.

BACKGROUND OF THE INVENTION

Global demand for liquid transportation fuel is projected to strain the ability to meet certain environmentally driven goals, for example, the conservation of oil reserves. Such demand has driven the development of technology which allows utilization of renewable resources to mitigate the depletion of oil reserves. This invention addresses the need for improved alternative fuel compositions and processes that allow for the conservation of oil reserves. Such compositions and processes would satisfy both fuel demands and environmental concerns.

Fuels, and in particular gasolines, are typically required to meet certain performance parameters or standards. Such standards are implemented for proper operation of engines or other fuel combustion apparatuses, or for other reasons such as environmental management. Examples of performance parameters include, but are not limited to, vapor pressure (e.g., Reid vapor pressure), sulfur content, oxygen content, aromatic hydrocarbon content, benzene content, olefin content, temperature at which 90% of the fuel is distilled (T90), temperature at which 50% of the fuel is distilled (T50), temperature at which 10% of the fuel is distilled (T10), octane ratings, anti-knock index, ASTM Driveability Index, combustion properties, and emissions performance parameters.

Standards for gasolines for sale within much of the United States are set forth by the American Society for Testing and Materials (ASTM), in particular in ASTM Standard Specification Number D-4814 ("ASTM D-4814"), which is incorporated by reference herein. Additional federal and state regulations supplement this standard. The specifications for gasolines set forth in ASTM D-4814 vary based on a number of parameters affecting volatility and combustion such as weather, season, geographic location and altitude. For this reason, gasolines produced in accordance with ASTM D-4814 are broken into vapor pressure/distillation classes AA, A, B, C, D and E, and vapor lock protection classes 1, 2, 3, 4, 5 and 6, each class having a set of specifications describing gasolines meeting the requirements of the respective classes. These specifications also set forth test methods for determining the parameters in the specification.

Ethanol is routinely blended with both finished gasoline and gasoline subgrades (e.g., blendstocks for oxygenate blending, or BOB) to make fuel blends. The blending process can occur at truck loading terminals where gasoline or a gasoline subgrade and ethanol are combined from separate storage tanks into the fuel product by commingling the streams during loading onto the tanker trucks for transportation to service stations. The blending process can be accomplished sequentially (i.e., first one component is loaded, followed by the other) or simultaneously by real-time stream blenders. Some such blending processes are commonly referred to as splash-blending.

Butanol is an important industrial chemical that is also suitable for use in fuel blends. The use of butanol in fuel blends has several advantages over ethanol. For example, because butanol has an energy content closer to that of gasoline, consumers face less of a compromise on fuel economy with butanol fuels. Also, butanol has a low vapor pressure, meaning that it can be easily added to conventional gasoline. Butanol can be used in higher blend concentrations than ethanol without requiring especially adapted vehicles. Butanol fuel blends are also less susceptible to separation in the presence of water than ethanol fuel blends. Further, butanol's chemical properties allow it to be blended at least 16% by volume in gasoline, thereby displacing more gasoline per gallon of fuel consumed than the standard 10% by volume ethanol blend.

Because of the different physical properties of butanol and ethanol, butanol cannot always be substituted directly for ethanol in fuel blends, particularly at relatively higher butanol concentrations (e.g., 20 vol. % or greater). At such concentrations, the relatively higher boiling point of butanol can alter the fuel blend's evaporation characteristics and lead to cold-start and warm-up driveability problems in vehicles. Additionally, gasoline blendstocks (BOBs) and subgrades that have been formulated for ethanol gasoline blends are not fully compatable with butanol. In this respect, one cannot simply substitute butanol for ethanol for blending with blendstocks or subgrades that have been formulated for a particular ethanol percentage. Prior to this application, if one were to substitute butanol for ethanol by blending butanol into a blendstock or subgrade that was formulated for ethanol, the resulting gasoline would not meet the requisite regulatory requirements for performance. In other words, such a substitution would result in a gasoline blend that is off-specification, and therefore, would be unmarketable.

One aspect of this invention provides compositions having butanol and other materials described herein useful in fuel blending. Such compositions can directly replace ethanol in fuel blends. For example, the instant butanol compositions can be used in gasoline blendstocks for oxygen blending (gasoline, BOB) or gasoline subgrades (e.g., butanol splash-blending compositions), including blendstocks and subgrades that have been formulated for ethanol. The invention also provides compositions containing butanol and other materials described herein that mollify the negative impact of relatively high butanol concentrations on the performance properties of a fuel blend (e.g., volatility). Because the compositions of the invention can be used as a substitute for ethanol directly at a terminal, they offer at least the same flexibility as ethanol in creating fuel blends. In this respect, the compositions herein allow fuel producers to use the same gasoline blendstocks and subgrades for butanol blends and ethanol blends, even if the blendstocks and subgrades were formulated for ethanol blends. Before, fuel producers could only use blendstocks and subgrades formulated for ethanol with ethanol. This novel advancement provides fuel producers with greater choices for fuel production and blends, without having to get or produce different or modified blendstocks and subgrades. Additionally, the present application allows terminals that blend ethanol with gasoline or gasoline subgrades, to produce fuels by conveniently switching from blending with ethanol to blending with butanol, without requiring exhaustion of the ethanol inventory, having to provide or produce different blendstocks or subgrades, or having to provide additional facilities for handling butanol blending. In this respect, the present application allows terminals that do not have a convenient way to handle butanol blending to still produce butanol-containing fuels. The present application also allows terminals, including, but not limited to truck terminals, to produce butanol gasoline blends using gasoline blendstocks, subgrades, or mixtures thereof formulated for ethanol at the terminal, without any additional modifications or equipment. Moreover, the present application allows existing ethanol production plants to retrofit the facility for the production of biobutanol, preferably in a manner that economically uses equipment that is already in place, so as to avoid costly equipment modifications or additions. Furthermore, the present invention provides methods for producing butanol compositions for fuel blending and fuel blends at a location where butanol is already produced using equipment which is already in place and available.

This invention addresses the need for improved alternative fuels that meet or exceed performance standards and parameters of ethanol-based fuel blends by providing compositions containing butanol and other materials described herein. Such compositions can directly replace or supplement ethanol in fuel blends. Thus, such compositions can satisfy both fuel demands and environmental concerns while providing acceptable performance standards and parameters. The present invention satisfies these and other needs, and provides further related advantages, as will be made apparent by the description of the embodiments that follow.

BRIEF SUMMARY OF THE INVENTION

One aspect of the invention relates to compositions for fuel blending comprising (i) butanol; (ii) optionally, an octane improving component; and (iii) a vapor pressure adjustment component. In another aspect of the invention, the butanol is n-butanol, 2-butanol, isobutanol, tert-butyl alcohol, or combinations thereof. In another aspect of the invention, the concentration of the butanol is from about 10 vol. % to about 99 vol. % based on the total volume of the composition. In another aspect, the concentration of the butanol is from about 60 vol. % to about 90 vol. % based on the total volume of the composition. In another aspect, the concentration of butanol is about 70 vol. % based on the total volume of the composition.

In one aspect of the invention, the octane improving component includes a high-octane aromatic, high-octane isoparaffin, alkylate, ethanol, or any combination thereof. In another aspect of the invention, the high-octane aromatic includes toluene, xylene, reformate, or any combination thereof. In another aspect, the high-octane isoparaffin includes iso-octane. In another aspect, the concentration of the octane improving component is from about 0 vol. % to about 50 vol. % based on the total volume of the composition. In another aspect, the concentration of the octane improving component is from about 5 vol. % to about 35 vol. % based on the total volume of the composition. In another aspect, the concentration of the octane improving component is about 20 vol. % based on the total volume of the composition.

In one aspect of the invention, the vapor pressure adjustment component includes n-butane, iso-butane, n-pentane, iso-pentane, mixed butanes, mixed pentanes, isomerate, natural gas liquids, light catalytically-cracked naphtha, light hydrocracked naphtha, hydrotreated light catalytically-cracked naphtha, natural gasoline, ethanol or any combination thereof. In another aspect of the invention, the concentration of the vapor pressure adjustment component is from about 1 vol. % to about 30 vol. % based on the total volume of the composition. In another aspect, the concentration of the vapor pressure adjustment component is from about 5 vol. % to about 20 vol. % based on the total volume of the composition. In another aspect, the concentration of the vapor pressure adjustment component is about 10 vol. % based on the total volume of the composition.

In one aspect of the invention, the composition further comprises a driveability component. In another aspect of the invention, the driveability component includes n-pentane, iso-pentane, 2,2-dimethyl butane, natural gas liquids, light catalytically-cracked naphtha, light hydrocracked naphtha, hydrotreated light catalytically-cracked naphtha, isomerate, hexanes or any combination thereof. In another aspect, the concentration of the driveability component is from about 1 vol. % to about 30 vol. % based on the total volume of the composition. In another aspect, the concentration of the driveability component is from about 5 vol. % to about 15 vol. % based on the total volume of the composition.

One aspect of the invention relates to a composition for fuel blending comprising (i) isobutanol; (ii) toluene; and (iii) n-butane. Another aspect of the invention relates to a composition for fuel blending comprising (i) from about 60 vol. % to about 90 vol. % isobutanol based on the total volume of the composition; (ii) from about 5 vol. % to about 35 vol. % toluene based on the total volume of the composition; and (iii) from about 5 vol. % to about 20 vol. % n-butane based on the total volume of the composition. In another aspect, the composition comprises (i) about 69.5 vol. % isobutanol based on the total volume of the composition; (ii) about 19.6 vol. % toluene based on the total volume of the composition; and (iii) about 10.9 vol. % n-butane based on the total volume of the composition. In another aspect, the composition of the invention is for blending with a gasoline or blendstock for oxygenate blending (BOB), for terminal blending with a gasoline, BOB or gasoline subgrade, or for splash-blending with a gasoline, BOB or gasoline subgrade.

One aspect of the invention relates to a fuel blend comprising (i) a composition for fuel blending described herein; and (ii) a fuel. In another aspect of the invention, the fuel includes a gasoline. In another aspect, the fuel includes a BOB or gasoline subgrade. In another aspect, the BOB is a BOB for reformulated gasoline (rBOB) or a conventional BOB (cBOB). In another aspect, the concentration of butanol is from about 1 vol. % to about 60 vol. % based on the total volume of the fuel blend. In another aspect, the concentration of butanol is about 16 vol. % or less based on the total volume of the fuel blend. In another aspect, the concentration of butanol is at least about 20 vol. % based on the total volume of the fuel blend. In another aspect, the concentration of the composition is from about 1 vol. % to about 50 vol. % based on the total volume of the fuel blend. In another aspect, the concentration of the composition is from about 10 vol. % to about 25 vol. % based on the total volume of the fuel blend. In another aspect, the concentration of the composition is about 23 vol. % based on the total volume of the fuel blend. In another aspect, the concentration of the fuel is from about 50 vol. % to about 99 vol. % based on the total volume of the fuel blend. In another aspect, the concentration of the fuel is from about 75 vol. % to about 90 vol. % based on the total volume of the fuel blend. In another aspect, the concentration of the fuel is about 77 vol. % based on the total volume of the fuel blend.

In one aspect of the invention, the fuel blend has similar performance properties when compared to a fuel blend comprising about 10 vol. % ethanol and about 90 vol. % gasoline or BOB. In another aspect of the invention, the fuel blend has the same performance properties when compared to a fuel blend comprising about 10 vol. % ethanol and about 90 vol. % gasoline or BOB. In another aspect, the fuel blend has improved performance properties when compared to a fuel blend comprising about 10 vol. % ethanol and about 90 vol. % gasoline or BOB.

In another aspect, the fuel blend has an octane rating of at least 80. In another aspect, the fuel blend has an octane rating of at least 90. In another aspect, the fuel blend has a minimum anti-knock index of 87 as measured by American Society for Testing and Materials (ASTM) D-2699 and D-2700. In another aspect, the fuel blend has a Reid vapor pressure of about 8 psi or less. In another aspect, the fuel blend has an ASTM Driveability Index of about 1250° F. or less. In another aspect, the fuel blend has Low-Butanol Driveability Index (LBDI) of about 1250° F. or less.

One aspect of the invention relates to a process for producing a fuel blend, comprising combining a composition for fuel blending described herein, with a fuel, such as a gasoline or BOB. In another aspect of the invention, the composition is transported to a terminal and combined with the gasoline or BOB at the terminal. In another aspect, the composition and gasoline or BOB are combined in a tank such as a tanker truck, a rail car or a marine vessel. In another aspect, the composition and gasoline or BOB are combined by adding the composition to the tank prior to adding the gasoline or BOB. In another aspect, the composition and gasoline or BOB are combined by adding the gasoline or BOB to the tank prior to adding the composition. In another aspect, the composition and gasoline or BOB are combined by adding the composition and gasoline or BOB to the tank simultaneously. In another aspect, the composition and gasoline or BOB are combined by adding the composition and gasoline or BOB to a tanker truck, rail car or marine vessel simultaneously. In another aspect, the composition is added to the gasoline or BOB at a location different from the location at which the composition was made. In another aspect, the composition is added to the gasoline or BOB at the same location at which the composition was made.

One aspect of the invention relates to a process for producing a composition for fuel blending described herein, comprising combining butanol, an octane improving component, and a vapor pressure adjustment component. In another aspect of the invention, the step of combining comprises (i) providing a butanol stream primarily including the butanol, an octane improving component stream primarily including the octane improving component, and a vapor pressure adjustment component stream primarily including the vapor pressure adjustment component; (ii) blending together the butanol stream with the octane improving component stream; and (iii) blending together the butanol stream with the vapor pressure adjustment component stream. In another aspect, the step of combining further comprises blending together the octane improving component stream and the vapor pressure adjustment component stream prior to blending these streams with the butanol stream.

In another aspect, the step of blending together the octane improving component stream and the vapor pressure adjustment component stream comprises holding the blended octane improving component stream and the vapor pressure adjustment component stream in a denaturant tank of a retrofitted ethanol production plant prior to blending these streams with the butanol stream.

In another aspect, the step of combining further comprises monitoring a flow rate of the butanol stream, monitoring a flow rate of the octane improving component stream, and monitoring a flow rate of the vapor pressure adjustment component stream. In another aspect, the step of combining further comprises controlling the flow rates of each of the butanol stream, the octane improving component stream, and the vapor pressure adjustment component stream.

In another aspect, the flow rates of each of the butanol stream, the octane improving component stream, and the vapor pressure adjustment component stream are controlled so that the product stream has (i) from about 60 vol. % to about 90 vol. % butanol based on the total volume of the composition, (ii) from about 5 vol. % to about 35 vol. % of the octane improving component based on the total volume of the composition; and (iii) from about 5 vol. % to about 20% vol. % of the vapor pressure adjustment component based on the total volume of the composition. In another aspect, the flow rate of the butanol stream is uncontrolled, and the step of combining further comprises controlling the flow rates of each of the octane improving component stream based on the monitored flow rate of the butanol stream. In another aspect, the flow rates of each of the octane improving component stream and the vapor pressure adjustment component stream are controlled so that the product stream has (i) from about 60 vol. % to about 90 vol. % butanol based on the total volume of the composition, (ii) from about 5 vol. % to about 35 vol. % of the octane improving component based on the total volume of the composition; and (iii) from about 5 vol. % to about 20 vol. % of the vapor pressure adjustment component based on the total volume of the composition.

In another aspect, the butanol stream and the octane improving component stream are blended together to produce a premix stream, and the premix stream is blended with the vapor pressure adjustment component stream to form the product stream. In another aspect, the step of combining further includes transporting the premix stream to a terminal, and the premix stream and the vapor pressure adjustment component stream are blended at the terminal.

Another aspect of the invention relates to a process for producing a composition free of an octane improving component, in which butanol and a vapor pressure component are combined. In one aspect, the butanol stream is blended with the vapor pressure adjustment component stream to form a product stream primarily including the composition.

Another aspect of the invention relates to a process for producing a composition for fuel blending, comprising introducing one of (i) an octane improving component only and (ii) a combination of the octane improving component and a vapor pressure adjustment component into a vessel capable of metering a denaturant from the vessel into a stream of ethanol, wherein the improvement comprises metering the one of (i) the octane improving component and (ii) the combination of the octane improving component and the vapor pressure adjustment component from the vessel into a stream of butanol rather than metering a denaturant from the vessel into a stream of ethanol.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
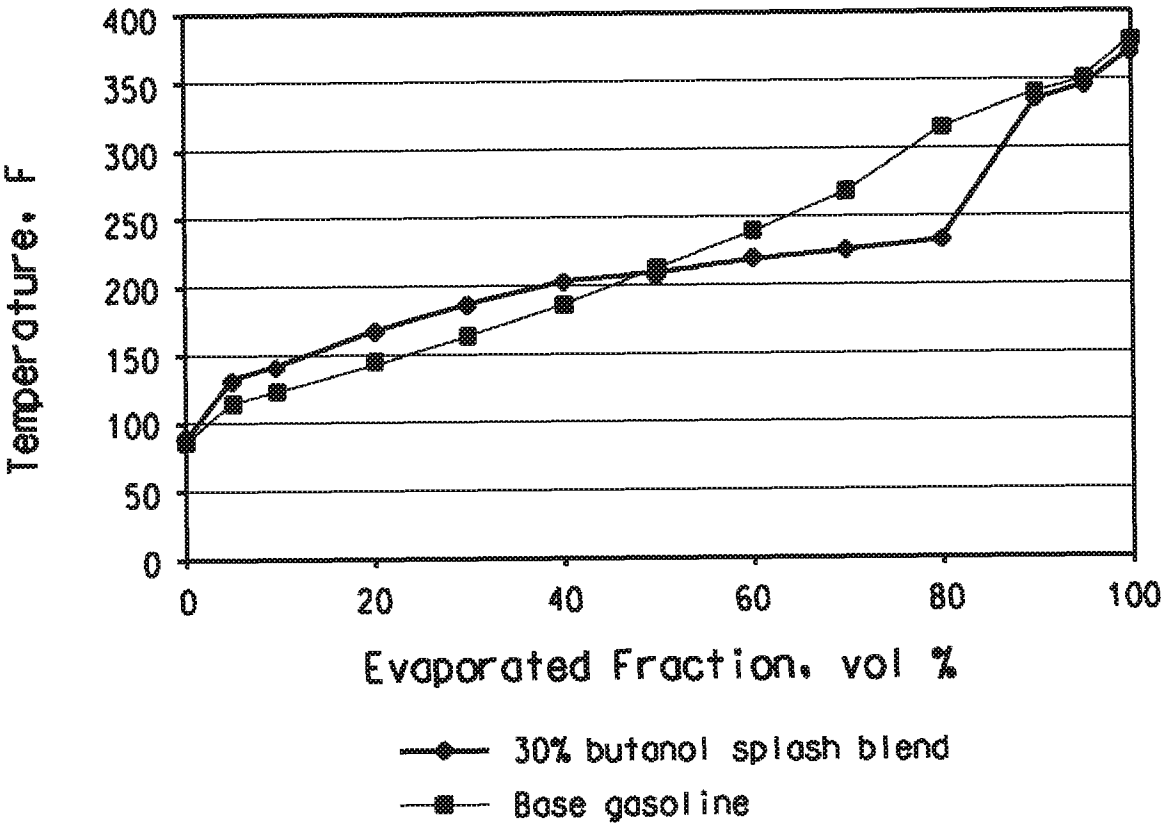
FIG. 1 depicts the effects of splash-blending 30 vol % isobutanol in conventional summer gasoline.

Unless defined otherwise, all technical and scientific terms used herein have the same meaning as commonly understood by one of ordinary skill in the art to which this invention belongs. In case of conflict, the present application including the definitions will control. Unless otherwise required by context, singular terms shall include pluralities and plural terms shall include the singular. All publications, patents and other references mentioned herein are incorporated by reference in their entireties for all purposes as if each individual publication or patent application were specifically and individually indicated to be incorporated by reference, unless only specific sections of patents or patent publications are indicated to be incorporated by reference.

Although methods and materials similar or equivalent to those disclosed herein can be used in practice or testing of the present invention, suitable methods and materials are disclosed below. The materials, methods and examples are illustrative only and are not intended to be limiting. Other features and advantages of the invention will be apparent from the detailed description and from the claims.

In order to further define this invention, the following terms, abbreviations and definitions are provided.

As used herein, the terms "comprises," "comprising," "includes," "including," "has," "having," "contains," or "containing," or any other variation thereof, are intended to be non-exclusive or open-ended. For example, a composition, a mixture, a process, a method, an article, or an apparatus that comprises a list of elements is not necessarily limited to only those elements but may include other elements not expressly listed or inherent to such composition, mixture, process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, the indefinite articles "a" and "an" preceding an element or component of the invention are intended to be nonrestrictive regarding the number of instances, i.e., occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as disclosed in the application.

As used herein, the term "about" modifying the quantity of an ingredient or reactant of the invention employed refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or to carry out the methods; and the like. The term "about" also encompasses amounts that differ due to different equilibrium conditions for a composition resulting from a particular initial mixture. Whether or not modified by the term "about", the claims include equivalents to the quantities. In one embodiment, the term "about" means within 10% of the reported numerical value, preferably within 5% of the reported numerical value.

The term "primarily including" defining components of a composition, refers to the composition having more than 50% of the components identified.

The term "fuel" as used herein, refers to any material that can be used to generate energy to produce mechanical work in a controlled manner. Examples of fuels include, but are not limited to, biofuels (i.e., fuels which in some way derived from biomass), gasoline or BOB.

The term "fuel blend" as used herein, refers to a mixture containing at least a composition of the invention and a fuel, such as gasoline, BOB or any combination thereof. A fuel blend includes, but is not limited to, an unleaded gasoline suitable for combustion in an automotive engine.

The term "gasoline" as used herein, refers to a volatile mixture of liquid hydrocarbons that can contain small amounts of additives and that are suitable for use as a fuel in spark ignition, internal combustion engines. This term includes, but is not limited to, conventional gasoline, oxygenated gasoline, reformulated gasoline, biogasoline (i.e., gasoline which in some way is derived from biomass), and Fischer-Tropsch gasoline.

The terms "blendstocks for oxygenate blending," "BOB," and "gasoline blendstock" as used herein, refer to gasoline blending components intended for blending with oxygenates and/or an alcohol fuel downstream of the refinery where it was produced. BOB can be a BOB for reformulated gasoline (rBOB), a conventional BOB (cBOB, a conventional gasoline blendstock), or a CARBOB as defined below. BOB often have an octane lower than that of the butanol or ethanol with which they are mixed in order to make a finished butanol or ethanol blended gasoline meet fuel standards. As used herein, BOB includes gasoline subgrades. BOB also includes gasoline blending components used for blending ethanol fuels, such as E10, E15, E20 or E85 BOB (unleaded regular or premium). Additionally, the terms "blendstocks for oxygenated blending," "BOB," and "gasoline blendstock" can be used interchangeably throughout this application.

The terms "Reformulated Blendstock for Oxygenate Blending" or "rBOB" refer to a non-oxygenated gasoline suitable for blending with an oxygenate, e.g., butanol. In certain embodiments, an rBOB meets the requirements of the U.S. Environmental Protection Agency under Section 211(k) of the Clear Air Act.

The term "CARBOB" refers to an rBOB suitable for use in California as regulated by the California Air Resources Board.

The terms "splash-blended" or "splash-blending" as used herein, refer to the process by which a component (e.g., an alcohol fuel such as ethanol or butanol) is blended with gasoline or BOB to make a fuel blend. For example, the process can occur at truck loading terminals, where the gasoline (or gasoline subgrade) and ethanol or butanol from separate storage tanks are combined into the fuel blend product by commingling the streams during loading onto tanker trucks for transportation to service stations. The process can be accomplished sequentially (i.e., first one component is loaded followed by another component) or simultaneously by real time stream blenders.

The term "butanol" as used herein, refers to n-butanol, 2-butanol, isobutanol, tert-butyl alcohol or combinations thereof. Moreover, the butanol can be derived from biological sources (e.g., biobutanol).

The terms "natural gas liquids" or "NGL," as used herein, refers to any isomer and combination of propane, butane, pentane, hexane, heptane, as well as higher molecular weight hydrocarbons. Additionally, methane, ethane, and mixtures thereof can be included.

The terms "American Society for Testing and Materials" and "ASTM" as used herein, refer to the international standards organization that develops and publishes voluntary consensus technical standards for a wide range of materials, products, systems, and services, including fuels.

The terms "performance properties" or "performance parameters" as used in relation to the compositions and fuel blends of the invention, refer to measurable physical characteristics associated with the use of such a composition or fuel (e.g., as an automotive fuel or component thereof for a vehicle having a spark-ignition engine). Examples of performance properties include, but are not limited to, octane rating (e.g., research octane or motor octane), anti-knock index, vapor pressure (e.g., Reid vapor pressure (Rvp)), Driveability Index, Low-Butanol Driveability Index, kinematic viscosity, net heat of combustion, viscosity, volatility, and corrosion (e.g., copper strip corrosion). Performance properties of the compositions and fuel blends of the invention, including those described herein, can be included in more than one category and can be analyzed and measured by more than one type of device. Performance properties and methods to measure performance properties are known, and can include, but are not limited to, those described in ASTM D-4814.

The term "octane rating" as used herein, refers to the measurement of the resistance of a fuel to auto-ignition in spark ignition internal combustion engines or to the measure of a fuel's tendency to burn in a controlled manner. An octane rating can be a research octane number (RON) or a motor octane number (MON). RON refers to the measurement determined by running the fuel in a test engine with a variable compression ratio under controlled conditions, and comparing the results with those for mixtures of iso-octane and n-heptane. RON can be determined using ASTM D2699. MON refers to the measurement determined using a similar test to that used in RON testing, but with a preheated fuel mixture, a higher engine speed, and ignition timing adjusted depending on compression ratio. MON can be determined using ASTM D2700.

The term "anti-knock index" as used herein, refers to the average of the RON and the MON values.

The term "octane improving component" as used herein, refers to a compound that improves the octane rating of a fuel upon addition of the compound to the fuel. Examples of octane improving components are known and include, but are not limited to, high-octane aromatics (e.g., toluene, xylene, reformate, and mixtures thereof), high-octane isoparaffins (e.g., iso-octane), alkylates, ethanol, isopentane, and any combinations thereof. An octane improving component can be used to compensate an octane deficiency between butanol-containing and ethanol-containing fuel blends.

The term "vapor pressure" as used herein, refers to the pressure of a vapor in thermodynamic equilibrium with its condensed phases in a closed system.

The term "vapor pressure adjustment component" as used herein, refers to a compound that alters the vapor pressure of a fuel compared to the vapor pressure of the fuel without the compound. The vapor pressure of a fuel should be sufficiently high to ensure ease of engine starting, but not so high as to contribute to vapor lock or excessive evaporative emissions and running losses. A vapor pressure adjustment component can be used to compensate a vapor pressure deficit that exists between a butanol-containing fuel blend and an ethanol-containing fuel blend. Examples of vapor pressure adjustment components include, but are not limited to, n-butane, iso-butane, n-pentane, iso-pentane, mixed butanes, mixed pentanes, ethanol, isomerate, natural gas liquids, light catalytically-cracked naphtha, light hydrocracked naphtha, hydrotreated light catalytically-cracked naphtha, and natural gasoline, as well as any combinations thereof.

The terms "Reid vapor pressure" and "Rvp" as used herein, refers to the absolute vapor pressure exerted by a liquid at 100° F. (37.8° C.) as determined by the test method ASTM D-323.

The term "T10 distillation value" as used herein, refers to the distillation temperature at which 10 vol-% of a liquid is evaporated.

The term "T30 distillation value" as used herein, refers to the distillation temperature at which 30 vol-% of a liquid is evaporated.

The term "T50 distillation value" as used herein, refers to the distillation temperature at which 50 vol-% of a liquid is evaporated.

The term "T70 distillation value" as used herein, refers to the distillation temperature at which 70 vol-% of a liquid is evaporated.

The term "T90 distillation value" as used herein, refers to the distillation temperature at which 90 vol-% of a liquid is evaporated.

The terms "ASTM Driveability Index," "Driveability Index" and "DI" as used herein, refer to the relationship between fuel distillation temperatures and vehicle cold-start and warm-up conditions. This measurement is a function of ambient temperature and fuel volatility expressed as the distillation at which 10%, 50% and 90% by volume of a liquid (e.g., a composition or fuel of the invention) is evaporated.

Driveability Index fuel standards and methods for determining Driveability Index are known and include, but are not limited to those described in ASTM D4814, and can be represented by the equation:

$$DI=1.5(T10)+3.0(T50)+1.0(T90)+1.33^\circ\ C.(2.4^\circ\ F.)\times \text{Ethanol }\% \quad \text{(Eq. 1)}$$

Equations 2a and 2b below present the "Low-Butanol Driveability Index" (LBDI), which is a modification of the ASTM DI above, and is a linear combination of temperatures, alcohol concentrations, and E200.

$$LBDI=a_1T_{10}+a_2T_{50}+a_3T_{90}+a_4\text{EtOH}+\text{BuOH}(a_5-a_6E200) \quad \text{(Eq. 2a)}$$

wherein LBDI is the modified driveability index; $T_{10}$, $T_{50}$, and $T_{90}$ are defined above, and are the temperatures for distillation of 10, 50 and 90 volume percent, respectively, of the blend; EtOH and BuOH are the volume percents of ethanol and butanol, respectively, in the blend; E200 is the volume percent of the blend that distills at temperatures up to 200° F.; and $a_1$, $a_2$, $a_3$, $a_4$, $a_5$ and $a_6$ are coefficients selected to afford a substantially linear relationship between the values of the aforesaid linear combination for gasoline blends containing butanol and optionally ethanol and the logarithms of the mean measured total weighted demerits for such blends, at concentrations of ethanol less than 20 volume percent, less than 19 volume percent, less than 18 volume percent, less than 17 volume percent, less than 16 volume percent, less than 15 volume percent, less than 14 volume percent, less than 13 volume percent, less than 12 volume percent, less than 11 volume percent, less than 10 volume percent, less than 9 volume percent, less than 8 volume percent, less than 7 volume percent, less than 6 volume percent, or less than 5 volume percent, at concentrations of butanol less than 30 volume percent, less than 29 volume percent, less than 28 volume percent, less than 27 volume percent, less than 26 volume percent, less than 25 volume percent, less than 24 volume percent, less than 23 volume percent, less than 22 volume percent, less than 21 volume percent, less than 20 volume percent, less than 19 volume percent, less than 18 volume percent, less than 17 volume percent, less than 16 volume percent, less than 15 volume percent, less than 14 volume percent, less than 13 volume percent, less than 12 volume percent, less than 11 volume percent, less than 10 volume percent, less than 9 volume percent, less than 8 volume percent, less than 7 volume percent, less than 6 volume percent, or less than 5 volume percent, and at total concentrations of ethanol and butanol less than 35 volume percent, less than 30 volume percent, less than 25 volume percent, less than 20 volume percent, less than 15 volume percent, less than 10 volume percent. In one embodiment, the blend is ethanol-free.

When the concentration of ethanol is less than 10 volume percent, $a_1$, $a_2$, $a_3$, and $a_4$, equal approximately 1.5, 3, 1, and 2.4, respectively, and Equation 2a becomes:

$$LBDI=1.5T_{10}+3T_{50}+T_{90}+2.4\text{EtOH}+\text{BuOH}(a_5-a_6E200) \quad \text{(Eq. 2b)}$$

Furthermore, when the concentration of ethanol is less than 10 volume percent and the concentration of butanol is less than about 40 volume percent, preferably less than about 30 volume percent, $a_1$, $a_2$, $a_3$, $a_4$, $a_5$ and $a_6$ equal approximately 1.5, 3, 1, 2.4, 16 and 0.3, respectfully, and Equations 2a and 2b become:

$$LBDI=1.5T_{10}+3T_{50}+T_{90}+2.4\text{EtOH}+\text{BuOH}(16-0.3E200) \quad \text{(Eq. 2c)}$$

or in other words:

$$LBDI=DI+\text{BuOH}(16-0.3E200) \quad \text{(Eq. 2d)}$$

wherein DI is the aforesaid ASTM DI. As seen from the form of the equation, LBDI collapses to the customary ASTM DI when butanol is absent, and hence the same specification limits established for DI are applicable for LBDI.

The term "driveability component" as used herein, refers to a compound that improves the Driveability Index of a fuel compared to the Driveability Index of the same fuel without the compound. A driveability component can compensate for differences in mid-range volatility and driveability between a composition or fuel blend of the invention and a fuel blend containing ethanol. Examples of driveability components are known and include, but are not limited to, n-pentane, iso-pentane, 2,2-dimethyl butane, ethanol, isomerate, hexanes, natural gas liquids, light catalytically-cracked naphtha, light hydrocracked naphtha, and hydrotreated light catalytically-cracked naphtha, as well as any combinations thereof.

Butanol Compositions for Fuel Blending and Fuel Blends

In embodiments of the invention, a composition for fuel blending is provided comprising (i) butanol; (ii) optionally, an octane improving component; and (iii) a vapor pressure adjustment component. In embodiments, the composition is for blending with a gasoline or blendstock for oxygenate blending (BOB), for terminal blending with a gasoline or BOB, or for splash-blending with a gasoline or BOB. In embodiments, the butanol is n-butanol, 2-butanol, isobutanol, tert-butyl alcohol or combinations thereof.

In embodiments, the composition comprises a butanol concentration of at least about 0.01, 0.1, 0.2, 0.3, 0.4, 0.5, 0.6, 0.7, 0.8, 0.9, 1.0, 1.5, 2, 2.5, 3, 3.5, 4, 4.5, 5, 5.5, 6, 6.5, 7, 7.5, 8, 8.5, 9, 9.5, 10, 15, 20, 25, 30, 35, 40, 45, 50, 55, 60, 65, 70, 75, 80, 85, 90, 95, 99 or 100 vol. % based on the total volume of the composition (v/v %), and useful ranges can be selected between any of these values (for example, about 0.01 vol. % to about 99 vol. %, about 0.01 vol. % to about 1 vol. %, about 0.1 vol. % to about 10 vol. %, about 0.5 vol. % to about 10 vol. %, about 1 vol. % to about 5 vol. %, about 5 vol. % to about 25 vol. %, about 5 vol. % to about 95 vol. %, about 5 vol. % to about 80 vol. %, about 10 vol. % to about 95 vol. %, about 15 vol. % to about 95 vol. %, about 20 vol. % to about 95 vol. %, about 25 vol. % to about 95 vol. %, about 30 vol. % to about 95 vol. %, about 35 vol. % to about 95 vol. %, about 40 vol. % to about 95 vol. %, about 45 vol. % to about 95 vol. %, about 50 vol. % to about 95 vol. %, about 1 vol. % to about 99 vol. %, about 5 vol. % to about 99 vol. %, about 10 vol. % to about 99 vol. %, about 15 vol. % to about 99 vol. %, about 20 vol. % to about 99 vol. %, about 25 vol. % to about 99 vol. %, about 30 vol. % to about 99 vol. %, about 35 vol. % to about 99 vol. %, about 40 vol. % to about 99 vol. %, about 45 vol. % to about 99 vol. %, about 50 vol. % to about 99 vol. %, about 5 vol. % to about 70 vol. %, about 10 vol. % to about 70 vol. %, about 15 vol. % to about 70 vol. %, about 20 vol. % to about 70 vol. %, about 25 vol. % to about 70 vol. %, about 30 vol.

% to about 70 vol. %, about 35 vol. % to about 70 vol. %, about 40 vol. % to about 70 vol. %, about 45 vol. % to about 70 vol. %, and about 50 vol. % to about 70 vol. %, about 60 vol. % to about 90 vol. % based on the total volume of the composition). The concentration of butanol can be readily determined and, in some embodiments, depends on the butanol or oxygen content of the desired composition for fuel blending or fuel blend.

In embodiments, the octane improving component is a high-octane aromatic, high-octane isoparaffin, alkylate, natural gasoline or any combination thereof. In embodiments, the high-octane aromatic is toluene, xylene, reformate, or any combination thereof. In embodiments, the high-octane isoparaffin is iso-octane. Ethanol can also be used as the octane improving component, either alone or in combination with the aforementioned components.

In embodiments, the concentration of the octane improving component is from at least about 0, 0.01, 0.1, 0.2, 0.3, 0.4, 0.5, 0.6, 0.7, 0.8, 0.9, 1.0, 1.5, 2, 2.5, 3, 3.5, 4, 4.5, 5, 5.5, 6, 6.5, 7, 7.5, 8, 8.5, 9, 9.5, 10, 15, 20, 25, 30, 35, 40, 45, 50, 55, 60, 65 or 70 vol. % based on the total volume of the composition (v/v %), and useful ranges can be selected between any of these values (for example, about 0.01 vol. % to about 70 vol. %, about 0.1 vol. % to about 70 vol. %, about 0.5 vol. % to about 70 vol. %, about 1 vol. % to about 70 vol. %, about 5 vol. % to about 70 vol. %, about 10 vol. % to about 70 vol. %, about 15 vol. % to about 70 vol. %, about 20 vol. % to about 70 vol. %, about 25 vol. % to about 70 vol. %, about 30 vol. % to about 70 vol. %, about 35 vol. % to about 70 vol. %, about 0.01 vol. % to about 50 vol. %, about 0.1 vol. % to about 50 vol. %, about 0.5 vol. % to about 50 vol. %, about 1 vol. % to about 50 vol. %, about 5 vol. % to about 50 vol. %, about 10 vol. % to about 50 vol. %, about 15 vol. % to about 50 vol. %, about 20 vol. % to about 50 vol. %, about 25 vol. % to about 50 vol. %, about 15 vol. % to about 35 vol. % based on the total volume of the composition). The concentration of octane improving component can be readily determined and, in some embodiments, depends on the octane rating or the concentration of BOB or butanol desired for the fuel blending composition or fuel blend.

In embodiments, the vapor pressure adjustment component is n-butane, iso-butane, n-pentane, iso-pentane, mixed butanes, mixed pentanes, ethanol, isomerate, hexanes, natural gas liquids, light catalytically-cracked naphtha, light hydrocracked naphtha, hydrotreated light catalytically-cracked naphtha, natural gasoline or any combination thereof.

In embodiments, the concentration of vapor pressure adjustment component is least about 0, 0.01, 0.1, 0.2, 0.3, 0.4, 0.5, 0.6, 0.7, 0.8, 0.9, 1.0, 1.5, 2, 2.5, 3, 3.5, 4, 4.5, 5, 5.5, 6, 6.5, 7, 7.5, 8, 8.5, 9, 9.5, 10, 15, 20, 25, 30, 35, 40, 45 or 50 vol. % based on the total volume of the composition (v/v %), and useful ranges can be selected between any of these values (for example, about 0.01 vol. % to about 50 vol. %, about 0.1 vol. % to about 50 vol. %, about 0.5 vol. % to about 50 vol. %, about 1 vol. % to about 50 vol. %, about 5 vol. % to about 50 vol. %, about 10 vol. % to about 50 vol. %, about 15 vol. % to about 50 vol. %, about 20 vol. % to about 50 vol. %, about 25 vol. % to about 50 vol. %, about 0.01 vol. % to about 30 vol. %, about 0.1 vol. % to about 30 vol. %, about 0.5 vol. % to about 30 vol. %, about 1 vol. % to about 30 vol. %, about 5 vol. % to about 30 vol. %, about 10 vol. % to about 30 vol. %, about 15 vol. % to about 30 vol. %, about 20 vol. % to about 30 vol. %, about 5 vol. % to about 15 vol. %, about 5 vol. % to about 15 vol. % based on the total volume of the composition). The concentration of vapor pressure adjustment component can be readily determined and in some embodiments, depends on the volatility grade desired for the fuel blending composition or fuel blend, or on the extent of octane rating deficit between a fuel blending composition or fuel blend and a given fuel blend containing ethanol.

In embodiments, the composition further comprises a driveability component. In embodiments, the driveability component is n-pentane, iso-pentane, 2,2-dimethyl butane, isomerate, hexanes, natural gas liquids, light catalytically-cracked naphtha, light hydrocracked naphtha, hydrotreated light catalytically-cracked naphtha or any combination thereof.

In embodiments, the concentration of driveability component is at least about 0, 0.01, 0.1, 0.2, 0.3, 0.4, 0.5, 0.6, 0.7, 0.8, 0.9, 1.0, 1.5, 2, 2.5, 3, 3.5, 4, 4.5, 5, 5.5, 6, 6.5, 7, 7.5, 8, 8.5, 9, 9.5, 10, 15, 20, 25, 30, 35, 40, 45 or 50 vol. % based on the total volume of the composition (v/v %), and useful ranges can be selected between any of these values (for example, from about 0.01 vol. % to about 50 vol. %, about 0.1 vol. % to about 50 vol. %, about 0.5 vol. % to about 50 vol. %, about 1 vol. % to about 50 vol. %, about 5 vol. % to about 50 vol. %, about 10 vol. % to about 50 vol. %, about 15 vol. % to about 50 vol. %, about 20 vol. % to about 50 vol. %, about 25 vol. % to about 50 vol. %, about 0.01 vol. % to about 30 vol. %, about 0.1 vol. % to about 30 vol. %, about 0.5 vol. % to about 30 vol. %, about 1 vol. % to about 30 vol. %, about 5 vol. % to about 30 vol. %, about 10 vol. % to about 30 vol. %, about 15 vol. % to about 30 vol. %, about 20 vol. % to about 30 vol. %, about 5 vol. % to about 15 vol. %, about 5 vol. % to about 20 vol. % based on the total volume of the composition). The concentration of driveability component can be readily determined and in some embodiments, depends on the volatility grade desired for the fuel blending composition or fuel blend, or on the extent of octane rating deficit between a fuel blending composition or fuel blend and a given fuel blend containing ethanol.

In some embodiments of the invention, the composition consists essentially of (i) butanol; (ii) an octane improving component; and (iii) a vapor pressure adjustment component. In embodiments, the composition comprises (i) isobutanol; (ii) an octane improving component; and (iii) a vapor pressure adjustment component. In embodiments, the composition comprises (i) isobutanol; (ii) toluene; and (iii) n-butane.

In embodiments, the composition comprises (i) from about 60 vol. % to about 90 vol. % of butanol based on the total volume of the composition; (ii) from about 5 vol. % to about 35 vol. % of an octane improving component based on the total volume of the composition; and (iii) from about 5 vol. % to about 20 vol. % of a vapor pressure adjustment component based on the total volume of the composition. In embodiments, the composition comprises (i) about 69.5 vol. % of butanol based on the total volume of the composition; (ii) about 19.6 vol. % an octane improving component based on the total volume of the composition; and (iii) about 10.9 vol. % of a vapor pressure adjustment component based on the total volume of the composition.

In embodiments, the composition comprises (i) from about 60 vol. % to about 90 vol. % isobutanol based on the total volume of the composition; (ii) from about 5 vol. % to about 35 vol. % toluene based on the total volume of the composition; and (iii) from about 5 vol. % to about 20% vol. % n-butane based on the total volume of the composition. In embodiments, the composition comprises (i) about 69.5 vol.

% isobutanol based on the total volume of the composition; (ii) about 19.6 vol. % toluene based on the total volume of the composition; and (iii) about 10.9 vol. % n-butane based on the total volume of the composition.

In embodiments, the composition has one, two, three, four, five, six, seven, eight, nine, ten, or more measurable performance properties. In embodiments, the composition has one, two, three, four, five, six, seven, eight, nine, ten, or more of the following performance properties: octane rating (e.g., research octane or motor octane), anti-knock index, vapor pressure (e.g., Reid vapor pressure), distillation properties, Driveability Index, Low-Butanol Driveability Index, kinematic viscosity, net heat of combustion, viscosity, volatility, and corrosion (e.g., copper strip corrosion). Performance properties of the compositions of the invention, including those described herein, can be included in more than one category and can be analyzed and measured by more than one type of device using known methods (e.g., those described in ASTM D-4814).

In embodiments, the composition has an octane rating of at least about 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, or 120 and useful ranges can be selected between any of these values (for example, from about 80 to about 110, or from about 87 to about 105). Octane rating standards and methods for measuring octane rating are known, and can include, but are not limited to, those described in ASTM D-4814, D-2699 and D-2700 and can include accepted reference values for numbers greater than 100.

In embodiments, the composition has an anti-knock index of at least about 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, or 120 and useful ranges can be selected between any of these values (for example, from about 80 to about 105, or from about 87 to about 100). Anti-knock index standards and methods for measuring anti-knock index are known, and can include, but are not limited to, those described in ASTM D-4814, D-2699 and D-2700 and can include accepted reference values for numbers greater than 100.

In embodiments, the composition has a vapor pressure (e.g., a Reid vapor pressure) of about 15, 14, 13, 12, 11, 10, 9, 8, 7, 6, 5, 4, 3, 2 or 1 psi (pound-force per square inch) or less, and useful ranges can be selected between any of these values (for example, from about 15 psi to about 5 psi, or from about 13 psi to about 5 psi). Vapor pressure fuel standards and methods for measuring vapor pressure are known and can include, but are not limited to, those described in ASTM D-4814.

In embodiments, the composition has distillation values (e.g., T10, T30, T50, T70, T90, IBP or FBP). In embodiments, the composition has a distillation IBP of at least about 40, 45, 50, 55, 60, 65, 70, 75, 80, 85, 90, 95, 100, 110, 120, 130, 140 or 150° F., and useful ranges can be selected between any of these values (for example, from about 85° F. to about 100° F.). In embodiments, the composition has a T10 distillation value of at least about 100, 105, 110, 115, 120, 125, 130, 135, 140, 145, 150, 155, 160, 165 or 170° F., and useful ranges can be selected between any of these values (for example, from about 130° F. to about 145° F.). In embodiments, the composition has a T30 distillation value of at least about 120, 125, 130, 135, 140, 145, 150, 155, 160, 165, 170, 175, 180, 185, 190, 195 or 200° F., and useful ranges can be selected between any of these values (for example, from about 150° F. to about 180° F.). In embodiments, the composition has a T50 distillation value of at least about 180, 185, 190, 195, 200, 205, 210, 215 or 220° F., and useful ranges can be selected between any of these values (for example, from about 200° F. to about 210° F.). In embodiments, the composition has a T70 distillation value of at least about 150, 160, 170, 180, 190, 200, 205, 210, 215, 220, 225, 230, 235, 240, 245, 250, 255, 260, 265, 270, 275 or 280° F., and useful ranges can be selected between any of these values (for example, from about 220° F. to about 250° F.). In embodiments, the composition has a T90 distillation value of at least about 150, 160, 170, 180, 190, 200, 205, 210, 215, 220, 225, 230, 235, 240, 245, 250, 260, 270° F., and useful ranges can be selected between any of these values (for example, from about 200° F. to about 240° F.). In embodiments, the composition has a FBP distillation value of at least about 150, 160, 170, 180, 190, 200, 205, 210, 215, 220, 225, 230, 235, 240, 245, 250, 260, 270° F., and useful ranges can be selected between any of these values (for example, from about 210° F. to about 250° F.). Distillation value fuel standards and methods for measuring distillation values are known and include, but are not limited to, those described in ASTM D-4814 or ASTM D-86.

Fuel Blends

In embodiments of the invention, fuel blends are provided comprising any of the butanol compositions described herein and a fuel such as a gasoline or BOB. In embodiments, the BOB is a BOB for reformulated gasoline (rBOB), a conventional BOB (cBOB) or combinations thereof. In embodiments, the BOB is a summer season gasoline BOB. In certain embodiments, the gasoline blend stock can be formulated for the addition of ethanol, and in particular at least 5% ethanol, at least 10% ethanol, or at least 15% ethanol. In other embodiments, the gasoline blend stock can be formulated for at least 75% ethanol, at least 80% ethanol, or at least 85% ethanol.

In embodiments, the concentration of butanol in the fuel blend is at least about 0.01, 0.1, 0.2, 0.3, 0.4, 0.5, 0.6, 0.7, 0.8, 0.9, 1.0, 1.5, 2, 2.5, 3, 3.5, 4, 4.5, 5, 5.5, 6, 6.5, 7, 7.5, 8, 8.5, 9, 9.5, 10, 15, 16, 20, 24, 25, 30, 35, 40, 45, 50, 55, 60, 65, 70, 75, 80, 85, 90, 95, 99 or 100 vol. % based on the total volume of the composition (v/v %), and useful ranges can be selected between any of these values (for example, about 0.01 vol. % to about 99 vol. %, about 0.01 vol. % to about 1 vol. %, about 0.1 vol. % to about 10 vol. %, about 0.5 vol. % to about 10 vol. %, about 1 vol. % to about 5 vol. %, about 5 vol. % to about 25 vol. %, about 5 vol. % to about 95 vol. %, about 5 vol. % to about 80 vol. %, about 10 vol. % to about 95 vol. %, about 15 vol. % to about 95 vol. %, about 20 vol. % to about 95 vol. %, about 25 vol. % to about 95 vol. %, about 30 vol. % to about 95 vol. %, about 35 vol. % to about 95 vol. %, about 40 vol. % to about 95 vol. %, about 45 vol. % to about 95 vol. %, about 50 vol. % to about 95 vol. %, about 1 vol. % to about 99 vol. %, about 5 vol. % to about 99 vol. %, about 10 vol. % to about 99 vol. %, about 15 vol. % to about 99 vol. %, about 20 vol. % to about 99 vol. %, about 25 vol. % to about 99 vol. %, about 30 vol. % to about 99 vol. %, about 35 vol. % to about 99 vol. %, about 40 vol. % to about 99 vol. %, about 45 vol. % to about 99 vol. %, about 50 vol. % to about 99 vol. %, about 5 vol. % to about 70 vol. %, about 10 vol. % to about 70 vol. %, about 15 vol. % to about 70 vol. %, about 20 vol. % to about 70 vol. %, about 25 vol. % to about 70 vol. %, about 30 vol. % to about 70 vol. %, about 35 vol. % to about 70 vol. %, about 40 vol. % to about 70 vol. %, about 45 vol. % to about 70 vol. %, and about 50 vol. % to about 70 vol. %, about 60 vol. % to about 90 vol. % based on the total volume of the composition). The concentration of butanol can be readily determined and, in some embodiments, depends on the butanol or oxygen content of the desired fuel blend.

In embodiments, the concentration of the butanol composition in the fuel blend is at least about 0.01, 0.1, 0.2, 0.3, 0.4, 0.5, 0.6, 0.7, 0.8, 0.9, 1.0, 1.5, 2, 2.5, 3, 3.5, 4, 4.5, 5, 5.5, 6, 6.5, 7, 7.5, 8, 8.5, 9, 9.5, 10, 15, 20, 25, 30, 35, 40, 45 or 50 vol. % based on the total volume of the composition (v/v %), and useful ranges can be selected between any of these values (for example, about 0.01 vol. % to about 60 vol. %, about 0.1 vol. % to about 50 vol. %, about 0.5 vol. % to about 50 vol. %, about 1 vol. % to about 50 vol. %, about 5 vol. % to about 50 vol. %, about 10 vol. % to about 50 vol. %, about 15 vol. % to about 50 vol. %, about 20 vol. % to about 50 vol. %, about 25 vol. % to about 50 vol. %, about 0.01 vol. % to about 30 vol. %, about 0.1 vol. % to about 30 vol. %, about 0.5 vol. % to about 30 vol. %, about 1 vol. % to about 30 vol. %, about 5 vol. % to about 30 vol. %, about 10 vol. % to about 30 vol. %, about 15 vol. % to about 30 vol. %, about 20 vol. % to about 30 vol. %, about 5 vol. % to about 15 vol. %, about 5 vol. % to about 20 vol. %, or about 10 vol. % to about 25 vol. % based on the total volume of the composition). In embodiments, the butanol composition described herein in present in the fuel blend in an amount from at least about 23 vol. % based on the total volume of the fuel blend.

In embodiments, the concentration of gasoline or BOB in the fuel blend is at least about 0.01, 0.1, 0.2, 0.3, 0.4, 0.5, 0.6, 0.7, 0.8, 0.9, 1.0, 1.5, 2, 2.5, 3, 3.5, 4, 4.5, 5, 5.5, 6, 6.5, 7, 7.5, 8, 8.5, 9, 9.5, 10, 15, 20, 25, 30, 35, 40, 45, 50, 55, 60, 65, 70, 75, 80, 85, 90, 95, 99 or 99.5 vol. % based on the total volume of the composition (v/v %), and useful ranges can be selected between any of these values (for example, about 0.01 vol. % to about 99 vol. %, about 5 vol. % to about 95 vol. %, about 5 vol. % to about 80 vol. %, about 10 vol. % to about 95 vol. %, about 15 vol. % to about 95 vol. %, about 20 vol. % to about 95 vol. %, about 25 vol. % to about 95 vol. %, about 30 vol. % to about 95 vol. %, about 35 vol. % to about 95 vol. %, about 40 vol. % to about 95 vol. %, about 45 vol. % to about 95 vol. %, about 50 vol. % to about 95 vol. %, about 1 vol. % to about 99 vol. %, about 5 vol. % to about 99 vol. %, about 10 vol. % to about 99 vol. %, about 15 vol. % to about 99 vol. %, about 20 vol. % to about 99 vol. %, about 25 vol. % to about 99 vol. %, about 30 vol. % to about 99 vol. %, about 35 vol. % to about 99 vol. %, about 40 vol. % to about 99 vol. %, about 45 vol. % to about 99 vol. %, about 50 vol. % to about 99 vol. %, about 5 vol. % to about 70 vol. %, about 10 vol. % to about 70 vol. %, about 15 vol. % to about 70 vol. %, about 20 vol. % to about 70 vol. %, about 25 vol. % to about 70 vol. %, about 30 vol. % to about 70 vol. %, about 35 vol. % to about 70 vol. %, about 40 vol. % to about 70 vol. %, about 45 vol. % to about 70 vol. %, and about 50 vol. % to about 70 vol. %, about 60 vol. % to about 90 vol. %, or about 75 vol. % to about 90 vol. % based on the total volume of the composition).

In embodiments, the concentration of gasoline or BOB is about 77 vol. % based on the total volume of the fuel blend. In embodiments, the fuel blend comprises the butanol composition at a concentration of about 23 vol. % and a gasoline or BOB at a concentration of about 77 vol. %.

In embodiments, the fuel blend has at least one, two, three, four, five, six, seven, eight, nine, ten, or more measurable performance properties. In embodiments, the fuel blend has at least one or more of the following performance properties: octane rating (e.g., research octane or motor octane), anti-knock index, vapor pressure (e.g., Reid vapor pressure), distillation properties, Driveability Index, Low-Butanol Driveability Index, kinematic viscosity, net heat of combustion, viscosity, volatility, and corrosion (e.g., copper strip corrosion), Ramsbottom carbon residue, ash content and smoke point. Performance properties of the fuel blends of the invention, including those described herein, can be included in more than one category and can be analyzed and measured by more than one type of device using known methods (e.g., those described in ASTM D-4814).

In embodiments, the fuel blend has an octane rating of at least about 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 101, 102, 103, 104, 105, 106, 107, 108, 109, 110, 111, 112, 113, 114, 115, 116. 117, 118, 119, or 120 and useful ranges can be selected between any of these values (for example, from about 80 to about 90, or from about 87 to about 91). Octane rating standards and methods for measuring octane rating are known, and include, but are not limited to, those described in ASTM D-4814, D-2699 and D-2700 and can include accepted reference values for numbers greater than 100.

In embodiments, the fuel blend has an anti-knock index of at least about 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 101, 102, 103, 104, 105, 106, 107, 108, 109, 110, 111, 112, 113, 114, 115, 116. 117, 118, 119, or 120 and useful ranges can be selected between any of these values (for example, from about 80 to about 90, or from about 87 to about 91). Anti-knock index standards and methods for measuring anti-knock index are known, and can include, but are not limited to, those described in ASTM D-4814, D-2699 and D-2700 and can include accepted reference values for numbers greater than 100.

In embodiments, the fuel blend has a vapor pressure (e.g., a Reid vapor pressure) of about 15, 14, 13, 12, 11, 10, 9, 8, 7, 6, 5, 4, 3, 2 or 1 psi (pound-force per square inch) or less, and useful ranges can be selected between any of these values (for example, from about 15 psi to about 5 psi, or from about 13 psi to about 5 psi). Vapor pressure fuel standards and methods for measuring vapor pressure are known and include, but are not limited to, those described in ASTM D-4814.

In embodiments, the fuel blend has a distillation value (e.g., T10, T30, T50, T70, T90, IBP or FBP). In embodiments, the fuel blend has a distillation IBP of at least about 40, 45, 50, 55, 60, 65, 70, 70, 75, 80, 85, 90, 95, 100, 110, 120, 130, 140 or 150° F., and useful ranges can be selected between any of these values (for example, from about 85° F. to about 100° F.). In embodiments, the fuel blend has a T10 distillation value of at least about 100, 105, 110, 115, 120, 125, 130, 135, 140, 145, 150, 155, 160, 165 or 170° F., and useful ranges can be selected between any of these values (for example, from about 130° F. to about 145° F.). In embodiments, the fuel blend has a T30 distillation value of at least about 120, 125, 130, 135, 140, 145, 150, 155, 160, 165, 170, 175, 180, 185, 190, 195 or 200° F., and useful ranges can be selected between any of these values (for example, from about 150° F. to about 180° F.). In embodiments, the fuel blend has a T50 distillation value of at least about 180, 185, 190, 195, 200, 205, 210, 215 or 220° F., and useful ranges can be selected between any of these values (for example, from about 200° F. to about 210° F.). In embodiments, the fuel blend has a T70 distillation value of at least about 150, 160, 170, 180, 190, 200, 205, 210, 215, 220, 225, 230, 235, 240, 245, 250, 255, 260, 265, 270, 275 or 280° F., and useful ranges can be selected between any of these values (for example, from about 220° F. to about 250°

F.). In embodiments, the fuel blend has a T90 distillation value of at least about 150, 160, 170, 180, 190, 200, 205, 210, 215, 220, 225, 230, 235, 240, 245, 250, 260, 270° F., and useful ranges can be selected between any of these values (for example, from about 200° F. to about 240° F.). In embodiments, the fuel blend has a FBP distillation value of at least about 150, 160, 170, 180, 190, 200, 205, 210, 215, 220, 225, 230, 235, 240, 245, 250, 260, 270° F., and useful ranges can be selected between any of these values (for example, from about 210° F. to about 250° F.). Distillation value fuel standards and methods for measuring distillation values are known and include, but are not limited to, those described in ASTM D-4814 or ASTM D-86.

In embodiments, the fuel blend has a Driveability Index of about 1000, 1010, 1020, 1030, 1040, 1050, 1060, 1070, 1080, 1090, 1100, 1120, 1130, 1140, 1150, 1160, 1170, 1180, 1190, 1200, 1210, 1220, 1230, 1240, 1250, 1260, 1270, 1280, 1290, 1300, 1310, 1320, 1330, 1340, 1350, 1360, 1370, 1380, 1390 or 1400 degrees Fahrenheit (° F.) or less, and useful ranges can be selected between any of these values (for example, from about 1100° F. to about 1250° F.). Driveability Index fuel standards and methods for measuring Driveability Index are known and include, but are not limited to, those described in ASTM D-4814.

In embodiments, the fuel blend has a Low-Butanol Driveability Index (LBDI) of about 1000, 1010, 1020, 1030, 1040, 1050, 1060, 1070, 1080, 1090, 1100, 1120, 1130, 1140, 1150, 1160, 1170, 1180, 1190, 1200, 1210, 1220, 1230, 1240, 1250, 1260, 1270, 1280, 1290, 1300, 1310, 1320, 1330, 1340, 1350, 1360, 1370, 1380, 1390 or 1400 degrees Fahrenheit (° F.) or less, and useful ranges can be selected between any of these values (for example, from about 1100° F. to about 1250° F.).

In embodiments, the fuel blend of the invention has similar performance properties when compared to a fuel blend comprising about 10 vol. % ethanol and about 90 vol. % gasoline or BOB. In embodiments, the fuel blend of the invention has the same performance properties when compared to a fuel blend comprising about 10 vol. % ethanol and about 90 vol. % gasoline or BOB. In embodiments, the fuel blend of the invention has improved performance properties when compared to a fuel blend comprising about 10 vol. % ethanol and about 90 vol. % gasoline or BOB.

In embodiments, the fuel blend of the invention has at least one, two, three, four, five, six, seven, eight, nine, ten, or more performance properties that are from about 10% greater to about 10% lower than the same performance property in a fuel blend comprising ethanol instead of butanol. In embodiments, the fuel blend of the invention has at least one, two, three, four, five, six, seven, eight, nine, ten, or more performance properties that are from about 20% greater to about 20% lower than the same performance property in a fuel blend comprising ethanol instead of butanol. In embodiments, the fuel blend of the invention has at least one, two, three, four, five, six, seven, eight, nine, ten, or more performance properties that are from about 30% greater to about 30% lower than the same performance property in a fuel blend comprising ethanol instead of butanol. In embodiments, the fuel blend comprising ethanol instead of butanol comprises about 10 vol. % ethanol and about 90 vol. % gasoline or BOB. In embodiments, the performance parameters are anti-knock index, Reid vapor pressure, Driveability Index and/or Low-Butanol Driveability Index. In embodiments, the anti-knock index is at least 87. In embodiments, the Driveability Index is 1250° F. or less. In embodiments, the Low-Butanol Driveability Index is 1250° F. or less.

In embodiments, the present invention relates to a fuel composition (e.g., an unleaded gasoline) suitable for combustion in an automotive engine. In embodiments, the present invention relates to an unleaded gasoline suitable for combustion in an automotive engine having one or more performance parameter(s) described herein. In embodiments, the present invention relates to a method for operating an automotive vehicle having a combustion engine, comprising introducing into the engine an unleaded gasoline described herein, and combusting the unleaded gasoline in the engine. In embodiments, the present invention relates to a method for aiding in minimizing air pollution caused at least in part by exhaust emissions of an automotive vehicle having a combustion engine, comprising introducing into the engine an unleaded gasoline described herein, and combusting the unleaded gasoline in the engine.

In embodiments, the present invention relates to a fuel composition (e.g., an unleaded gasoline) comprising a butanol composition for fuel blending described herein having one or more performance parameter(s) that comply with the applicable minimum performance parameter(s) of ASTM D-4814. In embodiments, the present invention relates to a fuel composition (e.g., an unleaded gasoline) comprising a butanol composition for fuel blending described herein having substantially the same minimum vapor pressure limits as an ethanol fuel that complies with the applicable minimum vapor pressure limits of ASTM D-5798. In embodiments, the fuel composition further comprises an octane improving component (e.g., isopentane).

Figure 3:
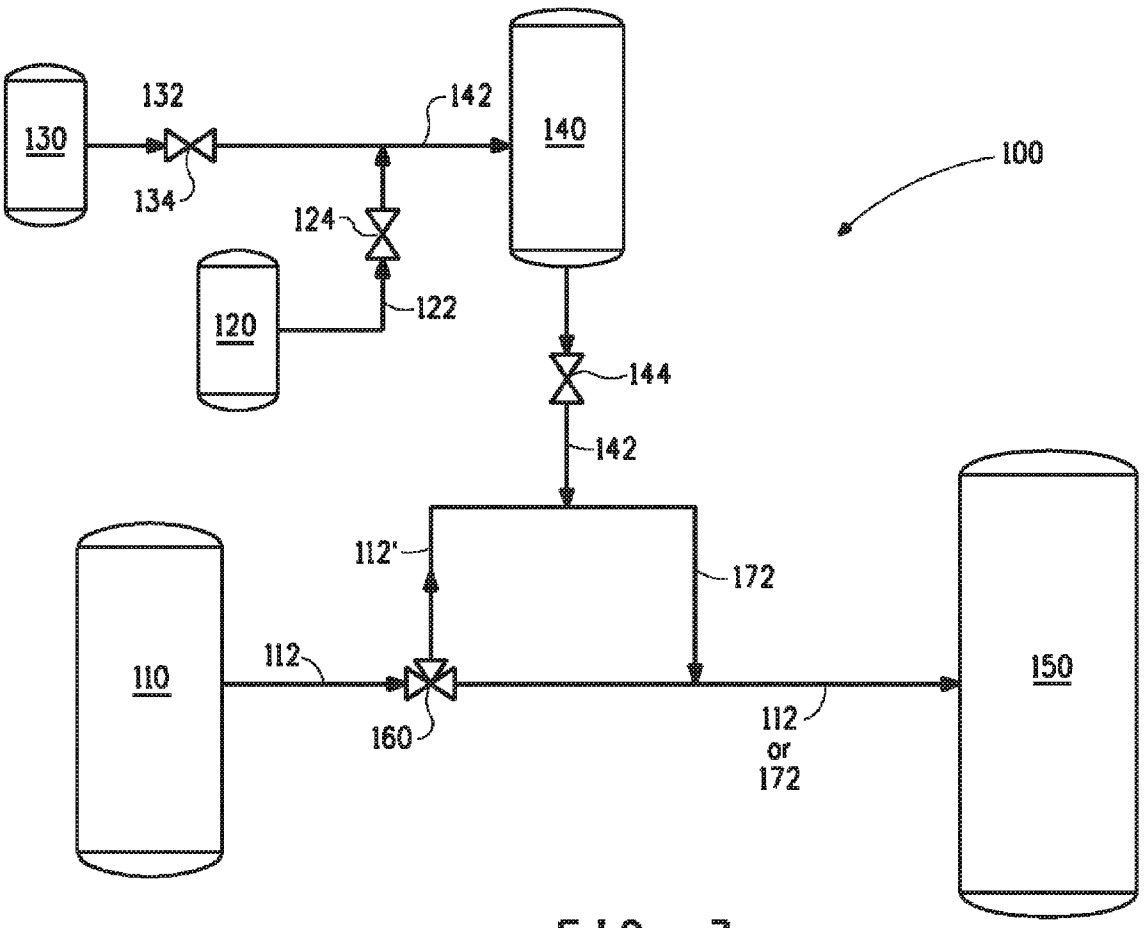
FIG. 3 illustrates an exemplary method and system for producing a butanol splash-blending composition in accordance with an embodiment of the present invention, in which butanol is side-stream blended with a premix containing an octane improving component and a vapor pressure adjustment component to produce the butanol splash-blending composition.
Figure 4:
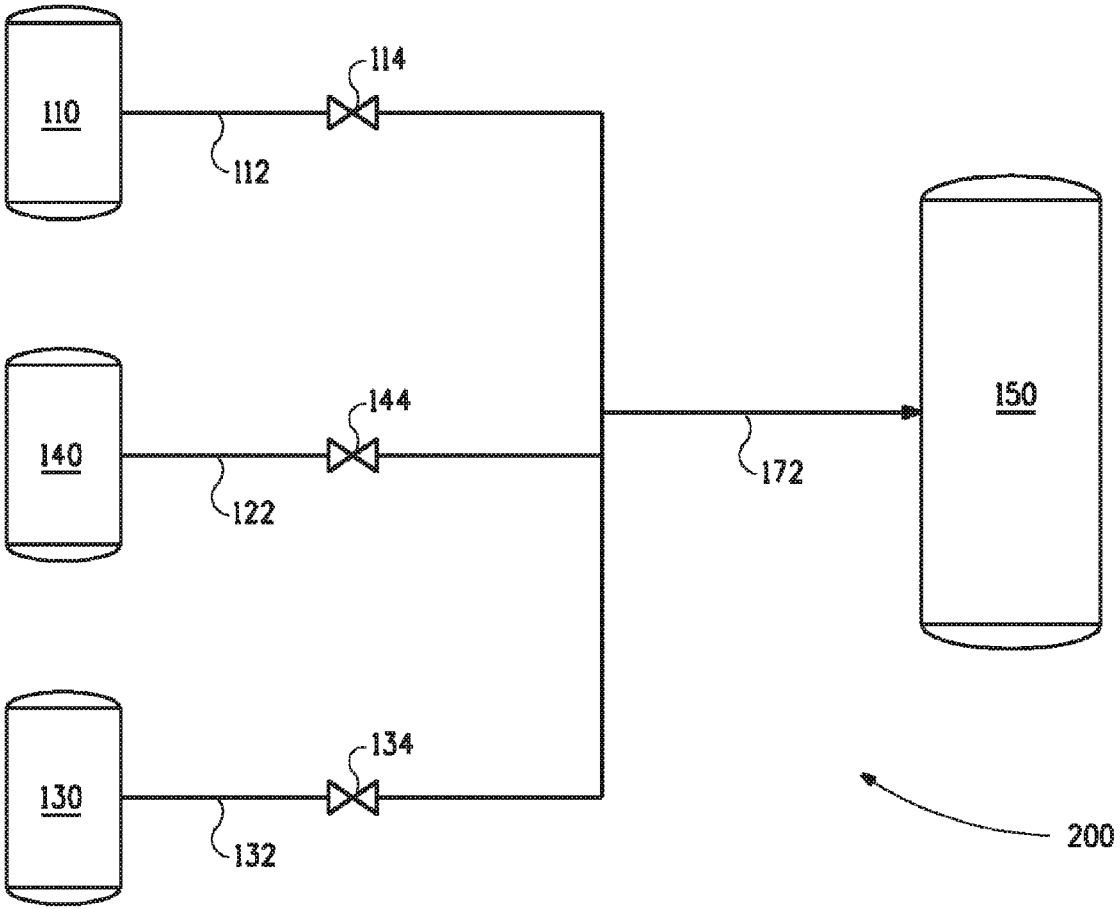
FIG. 4 illustrates an exemplary method and system for producing a butanol splash-blending composition in accordance with an embodiment of the present invention, in which butanol, an octane improving component, and a vapor pressure adjustment component are ratio-blended to produce the butanol splash-blending composition.

Systems and Methods for Producing Butanol Compositions for Fuel Blending and Fuel Blends Exemplary embodiments of systems and methods for producing butanol compositions according to the present invention will now be described with reference to FIGS. 3-5. FIG. 3 illustrates a system 100 for producing butanol splash-blending compositions in accordance with an embodiment of the present invention. Referring to FIG. 3, butanol (e.g., produced in a retrofitted ethanol plant) can be stored in tank 110 until a demand is made for the butanol to be loaded into a loading tank 150 for transport from the production plant to a terminal. Loading tank 150 can be any tank capable of holding the fuel compositions described herein, including, but not limited to, an on-site immovable storage tank and a moveable tank such as a tanker truck, a rail car or a marine vessel. When fuel-grade butanol is demanded, a stream of fuel-grade butanol 112 can be conveyed from tank 110 through a diverter control valve 160 which is controlled so as to not divert stream 112 to a side stream 112', but rather sends stream 112 directly to tank 150. When a butanol splash-blending composition is demanded, however, system 100 can provide side-stream blending of butanol 112 with other components, particularly an octane improving component (OIC) and a vapor pressure adjustment component (VPAC) to produce a butanol splash-blending composition that is delivered to loading tank 150 as stream 172. In such an instance, valve 160 is controlled to divert butanol stream 112 to a butanol side-stream 112' which is blended with OIC and VPAC to produce stream 172.

In some embodiments, the ethanol plant can be retrofitted to use components of an existing denaturation unit, including a denaturant tank 140 and control valve 144, for blending OIC and VPAC with the butanol. In a typical ethanol plant that manufactures fuel ethanol, the denaturation unit adds denaturation additive(s) (e.g., gasoline) to refined ethanol, typically as the ethanol is discharged into a loading tank. The denatured ethanol is unfit for human consumption, and therefore not subject to excise taxes. In the embodiment of FIG. 3, denaturant tank 140 stores a premix 142 of VPAC and OIC which can be metered via control valve 144 to blend with butanol side-stream 112'. Premix 142 is prepared to include the relative concentrations of VPAC and OIC for allowing a premix stream 142 and stream 112' to be blended to achieve desired concentration of VPAC, OIC and butanol in the final butanol splash-blending composition stream 172. In some embodiments, each of VPAC and OIC can be separately stored, and a stream from each of the respective storage tanks can be controllably blended to produce premix 142. In the embodiment of FIG. 3, OIC is stored in an appropriate tank 120 and VPAC is stored in an appropriate tank 130. In preparing the premix, a stream 132 of VPAC is metered through a control valve 134 and combined with a stream 122 of OIC that has been metered through a control valve 124. The resulting premix 142 is conveyed to denaturant tank 140 for holding until released through control valve 144 for blending with butanol side-stream 112'. Alternatively, in some embodiments, each of metered VPAC and OIC streams 132 and 122 can be fed to denaturant tank 140 and combined directly in tank 140. In such a case, since OIC stream 122 (e.g., toluene) would typically have a lower vapor pressure than VPAC stream 132 (e.g., n-butane, which is a gas at room temperature), OIC stream 122 should be metered into denaturant tank 140 prior to metering in OIC stream 132.

It should be understood that tanks 110, 120, 130, 140 and 150 should be configured to safely contain the respective compositions (i.e., butanol, OIC, VPAC, premix 142 and butanol splash-blending composition 172) based on the composition's physical properties (e.g., vapor pressures, physical state at room temperature, etc.). In some embodiments, denaturant tank 140 can store premix 142 without further modification, provided that the vapor pressure of the premix is below the permitted limit of the existing denaturant tank 140. For example, in some embodiments, in which OIC stream 122 is toluene and VPAC stream 132 is n-butane, an estimated Reid vapor pressure (Rvp) can be about 36 psia to about 40 psia. Accordingly, denaturant tank 140 should either be able to safely contain substances within these Rvps, or retrofitted as appropriate to allow such safe containment, as should be apparent to one skilled in the art. In some embodiments, only OIC stream 122 (typically having a lower Rvp than that of VPAC) can be stored in the denaturant tank (see, e.g., the embodiments of FIGS. 4 and 5), whereas VPAC stream 132 is stored separately (in tank 130) and combined with OIC stream 122 downstream of denaturant tank 140. In still other embodiments, denaturant tank 140 is not used for storage of OIC or VPAC, but rather each of OIC stream 122 and VPAC stream 132 are metered from their respective tanks 120 and 130 and combined to form premix 142, and premix stream 142 is directly conveyed to control valve 144, either by-passing denaturant tank 140 or being continuously channeled through to denaturant tank 140.

Other embodiments of systems and processes for producing butanol splash-blending compositions will now be described with reference to FIGS. 4 and 5. In FIGS. 4 and 5, like reference numbers as previously described with regard to the embodiment of FIG. 3 indicate identical or functionally similar elements, and therefore will not be described in detail again. FIG. 4 illustrates a system 200 for producing butanol splash-blending compositions in accordance with another embodiment of the present invention. In the embodiment of FIG. 4, each of butanol stream 112, OIC stream 122, and VPAC stream 132 are continuously blended in appropriate ratios to achieve their desired concentrations in the final butanol splash-blending composition stream 172. In the embodiment shown, OIC 122 is stored in denaturant tank 140, and VPAC 132 is separately stored in tank 130. Thus, butanol splash-blending composition 172 of a given composition can be produced on a continuous basis by controllably metering appropriate relative amounts of butanol stream 112, OIC stream 122, and VPAC stream 132 via respective control valves 114, 144, and 134. In addition, system 200 can use any other suitable process control equipment as known art for controlling blending of two or more product streams, including, for example, flow meters and a controller unit such as described the embodiment of FIG. 5. The resulting respective metered streams are then combined downstream of the control valves 114, 144, and 134 to form butanol splash-blending composition 172. It should be apparent that one or more additional streams, associated valves, etc. can be added as necessary for any additional components of butanol splash-blending composition 172.

Figure 5:
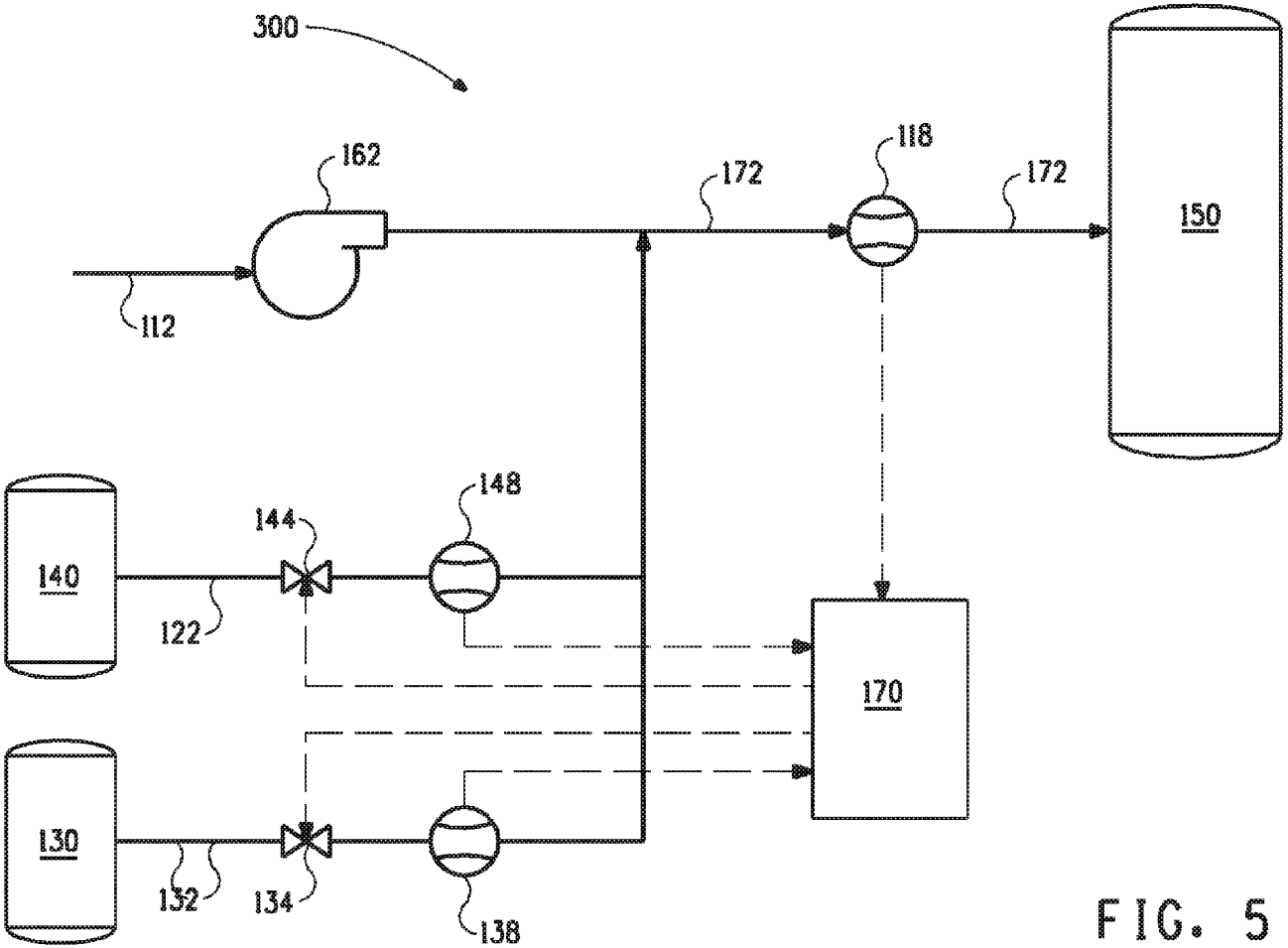
FIG. 5 illustrates an exemplary method and system for producing a butanol splash-blending composition in accordance with an embodiment of the present invention, in which butanol is wild-stream blended with a premix containing an octane improving component and a vapor pressure adjustment component to produce the butanol splash-blending composition.

FIG. 5 illustrates a system 300 for producing butanol splash-blending compositions in accordance with another embodiment of the present invention. In the embodiment of FIG. 3, butanol stream 112, OIC stream 122, and VPAC stream 132 are combined via wild stream continuous blending, in which one of butanol stream 112, OIC stream 122, and VPAC stream 132 is a wild stream having a "wild", or uncontrolled, flow that is monitored, and in which the other streams are metered at the necessary rate based on the rate of the uncontrolled stream so as to achieve butanol splash-blending composition 172 of a given composition. Referring to FIG. 5, butanol stream 112 is an uncontrolled stream being pumped (via pump 162) to loading tank 150 (e.g., an immovable tank or a moveable tank such as a tanker truck, a rail car or a marine vessel) and OIC stream 122 and VPAC 132 are each controlled streams metered via respective control valves 144 and 134. Uncontrolled butanol stream 112 may be fed from a storage tank (e.g., tank 110 of the embodiments in FIGS. 3 and 4), or alternatively, can be a continuous process stream immediately exiting a refining section of the production plant, for example. A flow meter 118 monitors the flow rate of butanol stream 112, and provides feedback to a controller unit 170 in electrical communication therewith. Flow meters 148 and 138 downstream of respective control valves 144 and 134 monitor the flow rates of respective metered flows of OIC stream 122 and VPAC 132, and provide feedback to controller unit 170 in electrical communication therewith. Based on the feedback from flow meters 118, 148 and 138, controller unit 170 controls valves 144 and 134 so that flow rates of OIC stream 122 and VPAC stream 132, relative to the flow rate of butanol stream 112, are appropriately metered for combining with butanol stream 112 to achieve butanol splash-blending composition 172 of a given composition.

In the embodiment of FIG. 5, OIC stream 122 and VPAC stream 132 are first blended together in a side stream before being combined with butanol stream 112, but it should be apparent that other configurations are possible. For example, in some embodiments, metered stream 122 and metered stream 132 can be individually fed to stream 112. Also, in the embodiment of FIG. 3, the flow rate of uncontrolled stream 112 is monitored by monitoring the flow rate of stream 172 (i.e., metered streams 122 and 132 are combined with stream 112 upstream of flow meter 118), but other embodiments are possible. For example, in some embodiments, the flow rate of uncontrolled stream 112 is monitored directly by positioning flow meter 118 upstream of where the side stream of metered streams 122 and 132 combine with stream 112. Further, in some embodiments, in which denaturant tank 140 stores premix 142 as described with respect to the embodiment of FIG. 3, tank 130, valve 134 and meter 138 can be omitted. It should be apparent that one or more additional streams, associated valves, etc. can also be added as necessary for any additional components of butanol splash-blending composition 172.

In any of the aforementioned embodiments, it should be apparent that butanol stream 112 need not be fed from storage tank 110 of butanol, but rather can be a continuous process stream immediately exiting a refining section of the production plant, such as described above with respect to the embodiment of FIG. 3. Moreover, in any of the aforementioned embodiments, it should be apparent that systems 100, 200 and 300 can be modified such that neither tank 140, control valve 144, nor both, nor any other of the components of an existing denaturation unit (such as the associated piping and pumps for conveying the denaturant(s)), are used for blending VPAC, OIC and butanol together, and such modifications would not depart from the scope of the present invention. Rather, in some embodiments, the process equipment (tanks, control valves, pumps, piping, etc.) of these systems are specifically designed for handling and blending the constituents of the butanol splash-blending compositions rather than being retrofitted from denaturation process equipment.

Moreover, in accordance with some embodiments of the present invention, the butanol splash-blending composition stream 172, such as produced using any of systems 100, 200 and 300, can be subsequently blended with a fuel, such as a gasoline or BOB, to produce a fuel blend. For example, in some embodiments, butanol splash-blending composition 172 stored in loading tank 150 can be transported to a terminal and combined with a fuel (e.g., a gasoline or BOB) at the terminal. In some embodiments, a loading tank, such as a tanker truck, a rail car or a marine vessel, is used for combining butanol splash-blending composition 172 with the gasoline or BOB. In some embodiments, the blending of the gasoline or BOB with butanol splash-blending composition 172 can be done at the butanol production plant. For example, butanol splash-blending composition stream 172 produced in any of systems 100, 200 and 300 can be metered into loading tank 150 along with metered flows of the gasoline or BOB to achieve the desired composition of the fuel blend. Butanol splash-blending composition stream 172 can be added to tank 150 prior to, during, or simultaneously with the gasoline or BOB stream, and in some embodiments, butanol splash-blending composition stream the gasoline or BOB 172 and the gasoline or BOB stream can be blended prior to being loaded into tank 150. It should be understood that any method of product blending may be used for combining a stream of gasoline or BOB with butanol splash-blending composition stream 172, including, for example, sidestream blending method similar to the blending process of system 100 for producing butanol splash-blending composition stream 172, a proportional continuous blending method similar to the blending process of system 200, and wild stream continuous blending method similar to the blending process of system 300. For example, for wild stream blending, an uncontrolled flow of gasoline or BOB pumped from a storage tank can be conveyed to tank 150. A controller unit and a flow meter (similar to controller unit 170 and flow meter 118 of system 300) can be used to monitor the flow of the stream of gasoline or BOB and control the flow of the butanol splash-blending composition stream 172 which is exiting any of systems 100, 200 and 300 and also being conveyed to tank 150. The controlled stream of the splash-blending composition stream 172 is combined with the uncontrolled stream of gasoline or BOB upstream of tank 150, thereby producing a fuel blend stream of desired composition that is introduced into tank 150.

The foregoing description of the specific embodiments of the devices and methods described with reference to the Figures will so fully reveal the general nature of the invention that others can, by applying knowledge within the skill of the art, readily modify and/or adapt for various applications such specific embodiments, without undue experimentation, without departing from the general concept of the present invention. For example, in some embodiments, butanol splash-blending composition 172 can be stored in tank 150 and pumped to a second loading tank, such as a tanker truck, a rail car or a marine vessel. For example, butanol splash-blending composition stream 172 can be controllably (proportionated stream) or uncontrollably (wild stream) pumped from tank 150 and combined with a metered stream of the gasoline or BOB from a storage tank, whereby the combined stream constituting a fuel blend of desired composition is then fed to the second loading tank. Alternatively, butanol splash-blending composition stream 172 can be controllably pumped from tank 150 and combined with gasoline or BOB being uncontrollably (wild stream) pumped from a storage tank, whereby the combined stream is then fed to the second loading tank. Alternatively, butanol splash-blending composition stream 172 and the gasoline or BOB stream can be separately added to the second tank directly, either simultaneously or sequentially (e.g., adding butanol splash-blending composition stream 172 before or after the gasoline or BOB stream). The second loading tank can be located at the butanol product plant. Alternatively, the second loading tank can be located at the terminal, with tank 150 of butanol splash-blending composition 172 being transported to the terminal for blending with the gasoline or BOB at the terminal using the second loading tank.

In some embodiments, systems 100, 200 and 300 can be operated to produce a splash blending composition 172 containing only butanol and OIC. For example, systems 100, 200 and 300 can be modified to exclude VPAC tank 130 and associated VPAC stream 132 from the process operation by omitting VPAC tank 130 and VPAC stream 132 from the system entirely. For example, for system 100, since denaturant tank 140 would no longer be needed to store premix 142 of VPAC and OIC if system produces a VPAC-free splash blending composition, denaturant tank 140 can be used instead to store OIC (similar to system 200), and tanks 120 and 130 can be omitted. Alternatively, systems 100, 200 and 300 can be operated to produce VPAC-free splash blending composition 172 by simply taking the supply of VPAC off-line (e.g., by closing valve 134 to prevent flow of stream 132). The VPAC-free splash blending composition 172 can be later combined with VPAC at the terminal. For example, VPAC can be stored at the terminal (e.g., in a tank similar to tank 130), and VPAC-free butanol splash-blending composition 172 stored in loading tank 150 can be transported to the terminal and combined with VPAC. The resulting splash-blending composition can then be stored or immediately combined with a fuel (e.g., a gasoline or BOB) at the terminal. In some embodiments, VPAC and the fuel can be combined with the VPAC-free butanol splash-blending composition simultaneously or sequentially (i.e., VPAC and then fuel can be added to the splash-blending composition, or fuel and then VPAC can be added).

In some embodiments, a composition of only butanol and VPAC has sufficient octane that OIC can be excluded from the composition. Thus, in some embodiments, systems 100, 200 and 300 can be operated to produce OIC-free splash blending composition 172 containing only butanol and VPAC. For example, systems 100, 200 and 300 can be modified to omit OIC tank 120 and associated OIC stream 122 from the system entirely. Alternatively, systems 100, 200 and 300 can be operated to produce OIC-free splash blending composition 172 by simply taking the supply of OIC off-line (e.g., by closing valve 124 in system 100, or valve 144 in systems 200 and 300, to prevent flow of stream 122). Alternatively, in some embodiments, the stream of fuel-grade butanol 112 is conveyed to tank 150, the butanol be transported to a terminal and blended with VPAC at the terminal.

In general, the present invention can allow for a method for producing a butanol gasoline blend comprising: (a) blending a composition comprising: (i) butanol; (ii) optionally, an octane improving component; and (iii) a vapor pressure adjustment component; with (b) a gasoline blend stock; wherein the gasoline blend stock can be formulated for the addition of ethanol. In certain embodiments, the gasoline blend stock can be formulated only for the addition of ethanol and additives, wherein the additives can be selected from the group consisting of: detergents, dispersants, deposit control additives, carburetor detergents, intake valve deposit detergents, intake system detergents, combustion chamber deposit control additives, fuel injector detergents, fluidizing agents, carrier oils and polymers, corrosion inhibitors, antioxidants, metal surface deactivators, metal surface passivators, combustion enhancing additives, cold-starting aids, spark promoters, spark improvers, spark plug detergents, surfactants, viscosity improvers, viscosity modifying agents, friction modifiers, fuel injector spray modifiers, fuel injector spray enhancers, fuel droplet size modification agents, volatility agents, oxygenates, water demulsifiers, water-rejection agents, water-separation agents, deicers, and mixtures thereof. Moreover, the instant invention allows the butanol gasoline blend to be produced at a terminal, wherein the terminal is a trucking, railway, or marine terminal.

Therefore, it should be apparent that such adaptations and modifications are intended to be within the meaning and range of equivalents of the disclosed exemplary embodiments, based on the teaching and guidance presented herein.

EXAMPLES

The present invention is further defined in the following Examples. It should be understood that these Examples, while indicating embodiments of the invention, are given by way of illustration only and are not intended to be comprehensive or limiting. From the above discussion and these Examples, one skilled in the art can ascertain the essential characteristics of this invention, and without departing from the spirit and scope thereof, can make various changes and modifications of the invention to adapt it to various uses and conditions.

General Methods and Abbreviations

Methods for producing the compositions and fuel blends and for measuring their performance parameters, such as those described in the following Examples, are described herein, known in the art and can be found, for example, in ASTM D-4814.

Abbreviations used in the Examples are as follows. "vol %", "vol. %" or "v/v %" is a measurement of concentration expressed in percentage of a liquid solute in a liquid solution, and calculated as the volume of the solute, divided by the total volume of solution, multiplied by 100%. "° F." means degree(s) Fahrenheit. "psi" means pound-force per square inch. "EtOH" means ethanol. "BuOH" means butanol. "BOB" means "blendstocks for oxygenate blending."

Example 1

Effects of 30 Vol. % Isobutanol on Driveability

The effects of splash-blending 30 vol. % isobutanol in a conventional summer gasoline were tested. Specifically, the distillation properties of unmodified gasoline ("Base gasoline") and 30 vol. % isobutanol splash-blended gasoline ("30% butanol splash blend") were measured using ASTM D-86 test methods. The results from these measurements are provided in FIG. 1 as the evaporated fraction of isobutanol in vol. % at a given temperature (° F.). These data show that the addition of isobutanol at 30 vol. % caused a loss of front-end volatility that can lead to cold-start and warm-up driveability problems when the resulting blend is used as a motor fuel.

Figure 2:
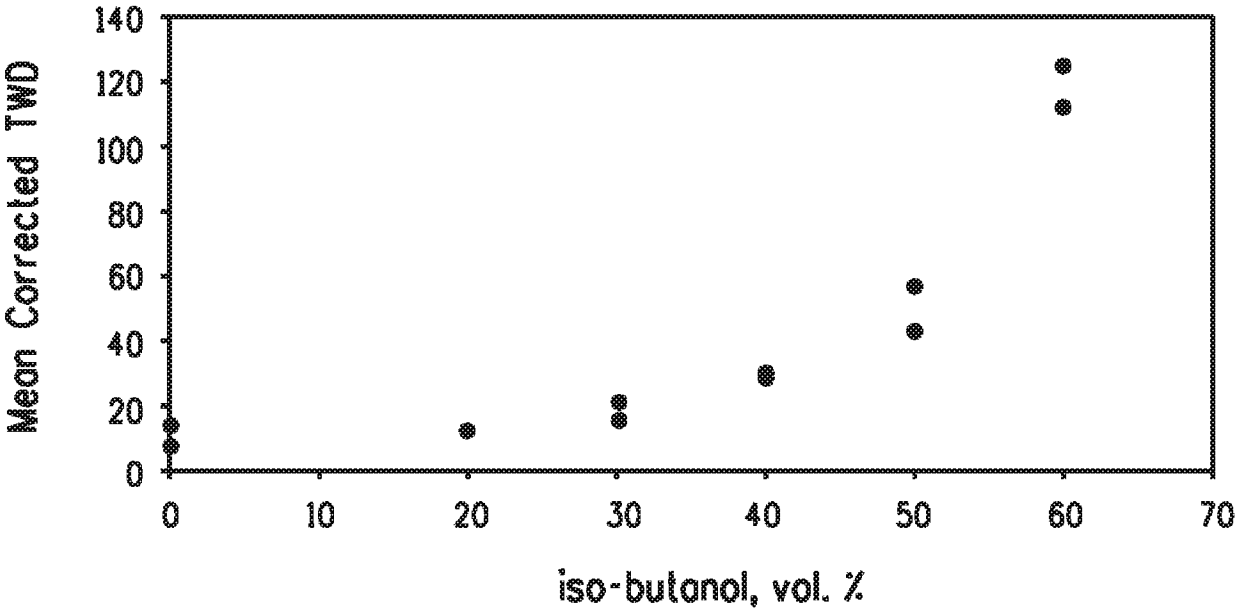
FIG. 2 depicts the effects of isobutanol on gasoline cold-start and warm-up performance.

The effects of 20, 30, 40, 50 and 60 vol. % isobutanol splash-blended gasoline on cold-start and warm-up performance were tested in a driveability performance test using six cars. The driveability faults observed with the splash-blended gasolines are presented in FIG. 2 and expressed as the mean total weighted demerits or TWD, corrected for temperature and vehicle effects. These data show that while driveability faults for the relatively lower isobutanol concentrations were similar although not as low as those of non-blended gasoline, the driveability faults for the relatively higher isobutanol concentrations increased dramatically compared to non-blended gasoline.

Therefore, these results show that driveability performance of gasoline splash-blended with relatively higher isobutanol concentrations such as 30 vol. % was reduced compared to non-blended gasoline.

Example 2

Key Performance Parameters of Fuel Blends Containing Butanol Compositions of the Invention are Very Similar to Those Containing Ethanol Performance parameters for a fuel blend containing a butanol composition of the invention and BOB, and a fuel blend containing ethanol and BOB were measured and compared. Specifically, a butanol composition containing 69.5 vol. % isobutanol, 19.6 vol. % toluene, and 10.9 vol. % n-butane was prepared in accordance with the methods described herein and blended with BOB such that the final fuel blend was composed of 77 vol. % BOB and 23% vol. of the butanol composition. The following performance parameters were then measured for the final fuel blend using standard methods described herein: research octane, motor octane, anti-knock index, Reid vapor pressure, D86 distillation IBP, T10, T30, T50, T70, T90 and FBP, Driveability Index and Low-Butanol Driveability Index. Table 1 shows the results of these measurements, along with the values for the same parameters of a theoretical standard fuel blend containing 10 vol. % ethanol and 90 vol. % BOB.

TABLE 1

Comparison of Performance Parameters of Fuel Blends Containing 10 vol. % Ethanol and 23 vol.% Butanol Composition

| Property | 90 vol. % BOB + 10 vol. % EtOH | 77 vol. % BOB + 23 vol. % Butanol Composition |
|---|---|---|
| Research Octane | 91.8 | 92.5 |
| Motor Octane | 84 | 83.6 |
| Anti-Knock Index | 87.9 | 88.1 |
| Reid vapor pressure (psi) | 7.2 | 7.1 |
| D86 Distillation IBP (° F.) | 97.5 | 86.4 |
| T10 (° F.) | 134.8 | 145.6 |
| T30 (° F.) | 150.1 | 181.5 |
| T50 (° F.) | 205.9 | 201.9 |
| T70 (° F.) | 246.7 | 218.9 |
| T90 (° F.) | 328.8 | 321.4 |
| FBP (° F.) | 400.8 | 394.2 |
| ASTM Driveability Index (° F.) | 1171 | 1146 |
| Low-Butanol Driveability Index (° F.) | 1171 | 1173 |

Table 1 shows the key performance properties of the two fuel blends are very similar and both fuels meet ASTM specifications for Anti-Knock Index of at least 87. Further, both fuel blends have low Reid vapor pressures that would allow for their use as a summer season fuel in volatile organic compound (VOC)-controlled regions in the U.S. (such as Chicago). Both fuel blends also meet ASTM Driveability Index and Low-Butanol Driveability Index specifications of 1250° F. or less to ensure a good cold-start and warm-up performance.

Example 3

Performance Parameters of Fuel Blends Containing Isobutanol Fuel Blending Compositions and rBOB Thirty rBOB fuel blends with isobutanol concentrations ranging from 16 vol % to 30 vol % can be tested for volatility properties and performance using industry standard methods (for example, ASTM D-4814).

First, isobutanol compositions for fuel blending could be prepared by combining isobutanol (iBuOH), a vapor pressure adjustment component, and optionally, an octane improving component using standard methods known in the art and described herein. Table 2 provides the percentage by volume ("%") of isobutanol, vapor pressure adjustment component, and optional octane improving component for isobutanol fuel blending compositions:

TABLE 2

Isobutanol compositions for fuel blending with rBOB

| Fuel Blending | Vapor pressure adjustment component | | Octane improving component | | iBuOH |
|---|---|---|---|---|---|
| Composition | Material | % | Material | % | % |
| 0 | n-butane | 14.3 | Toluene | 31.0 | 54.7 |
| 1 | n-butane | 12.1 | toluene | 7.5 | 80.4 |
| 2 | n-butane | 11.2 | toluene | 7.6 | 81.2 |
| 3 | n-butane | 13.8 | toluene | 7.4 | 78.8 |
| 4 | n-butane | 15.5 | toluene | 7.2 | 77.3 |

TABLE 2-continued

Isobutanol compositions for fuel blending with rBOB

| Fuel Blending | Vapor pressure adjustment component | | Octane improving component | | iBuOH |
|---|---|---|---|---|---|
| Composition | Material | % | Material | % | % |
| 5 | n-butane | 17.5 | toluene | 7.1 | 75.5 |
| 6 | n-butane | 20.1 | toluene | 6.8 | 73.1 |
| 7 | n-butane | 21.9 | toluene | 6.7 | 71.4 |
| 8 | n-butane | 11.9 | heavy (hvy) reformate | 11.9 | 76.2 |
| 9 | n-butane | 17.4 | hvy reformate | 11.2 | 71.4 |
| 10 | n-butane | 21.9 | hvy reformate | 10.5 | 67.5 |
| 11 | n-butane | 9.7 | alkylate | 26.7 | 63.6 |
| 12 | n-butane | 14.8 | alkylate | 25.2 | 60.0 |
| 13 | n-butane | 19.2 | alkylate | 21.7 | 59.1 |
| 14 | isopentane | 49.2 | | 0.0 | 50.8 |
| 15 | n-butane | 7.4 | isopentane | 18.3 | 74.3 |
| 16 | natural gasoline | 46.9 | toluene | 14.3 | 38.8 |
| 17 | isomerate | 48.7 | toluene | 2.6 | 48.8 |
| 18 | n-butane | 8.4 | | 0.0 | 91.6 |
| 19 | n-butane | 13.8 | | 0.0 | 86.2 |
| 20 | n-butane | 18.7 | | 0.0 | 81.3 |
| 21 | natural gasoline | 40.4 | toluene | 6.6 | 53.0 |
| 22 | natural gasoline | 47.1 | toluene | 8.6 | 44.3 |
| 23 | natural gasoline | 55.3 | toluene | 10.8 | 33.9 |
| 24 | isomerate | 40.2 | | 0.0 | 59.8 |
| 25 | isomerate | 47.0 | | 0.0 | 53.0 |
| 26 | isomerate | 56.7 | | 0.0 | 43.3 |
| 27 | isomerate | 63.9 | | 0.0 | 36.1 |
| 28 | n-butane | 6.3 | | 0.0 | 93.7 |
| 29 | n-butane | 7.6 | | 0.0 | 92.4 |
| 30 | n-butane | 14.0 | | 0.0 | 86.0 |

Next, fuel blends can be prepared by combining the isobutanol fuel blending compositions and ULR E10 rBOB using standard methods known in the art and described herein. Table 3 provides the Reid vapor pressure (Rvp) in units of pound-force per square inch (psi) for the rBOB (rBOB Rvp), the percentage by volume of isobutanol blending composition that is combined with the rBOB to produce the fuel blend (% iBuOH blending composition in fuel), and the percentage by volume of isobutanol in the final fuel blend (% iBuOH in fuel blend).

TABLE 3

Compositions and performance parameters of fuel blends containing rBOB and isobutanol fuel blending compositions

| Fuel | rBOB | | % iBuOH blending composition | % iBuOH in fuel | Performance parameters | | | Volatility | |
|---|---|---|---|---|---|---|---|---|---|
| Blend | Rvp | Type | in fuel | blend | RON | MON | Rvp | Class | Rvp max |
| 0 | 6.2 | U1R E10 | 21.0 | 11.5 | 90.6 | 83.4 | 7.6 | AA | 7.8 |
| 1 | 6.6 | U1R E10 | 19.9 | 16.0 | 90.8 | 83.1 | 7.6 | AA | 7.8 |
| 2 | 5.8 | U1R E10 | 19.7 | 16.0 | 90.8 | 83.1 | 6.8 | "7 psi" | 7.0 |
| 3 | 7.9 | U1R E10 | 20.3 | 16.0 | 90.8 | 83.1 | 8.7 | A | 9.0 |
| 4 | 8.9 | U1R E10 | 20.7 | 16.0 | 90.9 | 83.1 | 9.7 | B | 10.0 |
| 5 | 10.5 | U1R E10 | 21.2 | 16.0 | 90.9 | 83.1 | 11.2 | C | 11.5 |
| 6 | 12.7 | U1R E10 | 21.9 | 16.0 | 90.9 | 83.1 | 13.2 | D | 13.5 |
| 7 | 14.3 | U1R E10 | 22.4 | 16.0 | 90.9 | 83.1 | 14.8 | E | 15.0 |
| 8 | 6.6 | U1R E10 | 21 | 16.0 | 90.9 | 83.1 | 7.6 | AA | 7.8 |
| 9 | 10.5 | U1R E10 | 22.4 | 16.0 | 91.0 | 83.1 | 11.2 | C | 11.5 |
| 10 | 14.3 | U1R E10 | 23.7 | 16.0 | 91.0 | 83.1 | 14.8 | E | 15 |
| 11 | 6.6 | U1R E10 | 25.2 | 16.0 | 90.8 | 83.3 | 7.8 | AA | 7.8 |
| 12 | 10.5 | U1R E10 | 26.7 | 16.0 | 90.8 | 83.3 | 11.4 | C | 11.5 |
| 13 | 14.3 | U1R E10 | 27.1 | 16.0 | 90.8 | 83.2 | 15.0 | E | 15 |
| 14 | 10.5 | U1R E10 | 31.5 | 16.0 | 91.2 | 84.0 | 11.5 | C | 11.5 |
| 15 | 10.5 | U1R E10 | 21.5 | 16.0 | 91.0 | 83.4 | 11.5 | C | 11.5 |
| 16 | 5.8 | U1R E10 | 41.2 | 16.0 | 91.0 | 83.1 | 7.0 | "7 psi" | 7.0 |
| 17 | 5.8 | U1R E10 | 32.8 | 16.0 | 90.8 | 83.4 | 7.0 | "7 psi" | 7.0 |
| 18 | 5.8 | U1R E10 | 24.0 | 22.0 | 91.6 | 83.3 | 7.0 | "7 psi" | 7 |
| 19 | 6.6 | U1R E10 | 25.5 | 22.0 | 91.6 | 83.3 | 7.8 | AA | 7.8 |
| 20 | 14.3 | U1R E10 | 27.1 | 22.0 | 91.7 | 83.3 | 14.9 | E | 15 |
| 21 | 5.8 | U1R E10 | 41.5 | 22.0 | 91.2 | 82.9 | 7.0 | "7 psi" | 7 |
| 22 | 6.6 | U1R E10 | 49.7 | 22.0 | 91.2 | 82.9 | 7.8 | AA | 7.8 |
| 23 | 7.9 | U1R E10 | 64.9 | 22.0 | 91.3 | 82.8 | 8.9 | A | 9 |
| 24 | 5.8 | U1R E10 | 36.8 | 22.0 | 91.7 | 83.7 | 7.0 | "7 psi" | 7 |
| 25 | 6.6 | U1R E10 | 41.5 | 22.0 | 91.7 | 83.8 | 7.8 | AA | 7.8 |
| 26 | 7.9 | U1R E10 | 50.9 | 22.0 | 91.8 | 84.1 | 9.0 | A | 9 |
| 27 | 8.9 | U1R E10 | 61.0 | 22.0 | 91.8 | 84.4 | 9.9 | B | 10 |
| 28 | 5.8 | U1R E10 | 32.03 | 30.0 | 93.3 | 84.0 | 7.0 | "7 psi" | 7 |
| 29 | 6.6 | U1R E10 | 32.45 | 30.0 | 93.3 | 84.0 | 7.8 | AA | 7.8 |
| 30 | 10.5 | U1R E10 | 34.9 | 30.0 | 93.4 | 84.0 | 11.5 | C | 11.5 |

The research octane number (RON), motor octane number (MON), and Rvp for each fuel can be tested using industry standard methods and provided in Table 3. The corresponding volatility class (AA, A, B, C, D or E in accordance with ASTM D-4814 or 7 psi) and the maximum Rvp (Rvp max) for each class are also provided in Table 3.

Example 4

Performance Parameters of Fuel Blends Containing Isobutanol Fuel Blending Compositions and rBOB Five rBOB fuel blends with isobutanol concentrations ranging from 16 vol % to 30 vol % can be tested for volatility properties and performance using industry standard methods (for example, ASTM D-4814 and LBDI as described herein).

First, isobutanol compositions for fuel blending can be prepared by combining isobutanol (iBuOH), a vapor pressure adjustment component, and optionally, an octane improving component and/or a driveability component using standard methods known in the art and described herein. Table 4 provides the percentage by volume ("%") of isobutanol, vapor pressure adjustment component, and optional octane improving component and/or driveability component for the isobutanol fuel blending compositions:

TABLE 4

Isobutanol compositions for fuel blending with rBOB

| Fuel Blending | Vapor pressure adjustment component | | Octane improving component | | Driveability component | | iBuOH |
|---|---|---|---|---|---|---|---|
| Composition | Material | % | Material | % | Material | % | % |
| 31 | n-butane | 4.8 | toluene | 12.6 | | 0.0 | 82.6 |
| 32 | n-butane | 2.3 | | 0.0 | isomerate | 8.3 | 89.4 |
| 33 | n-butane | 4.4 | toluene | 11.5 | | 0.0 | 84.1 |
| 34 | n-butane | 2.2 | toluene | 1.8 | isomerate | 9.2 | 86.8 |
| 35 | isomerate | 20.7 | | 0.0 | isohexanes | 5.2 | 74.1 |

Next, fuel blends can be prepared by combining the isobutanol fuel blending compositions and rBOB (ULR E10 rBOB or premium E10 rBOB) using standard methods known in the art and described herein. Table 5 provides the Reid vapor pressure (Rvp) in units of pound-force per square inch (psi) for the rBOB (rBOB Rvp), the percentage by volume of isobutanol blending composition that is combined with the rBOB to produce the fuel blend (% iBuOH blending composition in fuel), and the percentage by volume of isobutanol in the final fuel blend (% iBuOH in fuel blend).

TABLE 5

Compositions and performance parameters of fuel blends containing rBOB and isobutanol fuel blending compositions

| Fuel | rBOB | | % iBuOH blending composition | % iBuOH in fuel | Performance parameters | | | | Volatility | Rvp |
|---|---|---|---|---|---|---|---|---|---|---|
| Blend | Rvp | Type | in fuel | blend | RON | MON | Rvp | LBDI | Class | max |
| 31 | 5.8 | ULR E10 | 19.4 | 16.0 | 91.9 | 82.1 | 7.0 | 1171 | 7 psi | 7.0 |
| 32 | 5.8 | ULR E10 | 33.6 | 30.0 | 93.8 | 83.0 | 7.0 | 1244 | 7 psi | 7.0 |
| 33 | 5.8 | premium E10 | 19.0 | 16.0 | 98.0 | 88.1 | 7.0 | 1230 | 7 psi | 7.0 |
| 34 | 5.8 | premium E10 | 25.4 | 22.0 | 98.1 | 87.9 | 7.0 | 1246 | 7 psi | 7.0 |
| 35 | 5.8 | premium E10 | 40.5 | 30.0 | 98.4 | 87.9 | 7.0 | 1242 | 7 psi | 7.0 |

The research octane number (RON), motor octane number (MON), Rvp, and low-butanol driveability index (LBDI) for each fuel can be tested using industry standard methods or as described herein and provided in Table 5. The corresponding volatility class and the maximum Rvp for that class are also provided in Table 5.

Example 5

Performance Parameters of Fuel Blends Containing Isobutanol Fuel Blending Compositions and CARBOB Eleven CARBOB fuel blends with isobutanol concentrations ranging from 16 vol % to 30 vol % can be tested for volatility properties and performance using industry standard methods (for example, ASTM D-4814 and LBDI as described herein).

First, isobutanol compositions for fuel blending can be prepared by combining isobutanol (iBuOH), a vapor pressure adjustment component, and optionally, an octane improving component or a driveability component using standard methods known in the art and described herein. Table 6 provides the percentage by volume ("%") of isobutanol, vapor pressure adjustment component, and optional octane improving component and/or driveability component for the isobutanol fuel blending compositions:

TABLE 6

Isobutanol compositions for fuel blending with CARBOB

| Fuel Blending | Vapor pressure adjustment component | | Octane improving component | | Driveability component | | iBuOH |
|---|---|---|---|---|---|---|---|
| Composition | Material | % | Material | % | Material | % | % |
| 36 | n-butane | 11.6 | toluene | 6.5 | | 0.0 | 81.9 |
| 37 | n-butane | 9.0 | | 0.0 | | 0.0 | 91.0 |
| 38 | n-butane | 5.1 | | 0.0 | isomerate | 11.7 | 83.3 |
| 39 | n-butane | 4.5 | | 0.0 | natural gasoline | 15.0 | 80.5 |
| 40 | n-butane | 13.4 | toluene | 4.3 | | 0.0 | 82.3 |
| 41 | n-butane | 10.5 | | 0.0 | | 0.0 | 89.5 |
| 42 | n-butane | 34.4 | | 0.0 | | 0.0 | 65.6 |
| 43 | n-butane | 28.1 | | 0.0 | | 0.0 | 71.9 |
| 44 | n-butane | 24.1 | | 0.0 | | 0.0 | 75.9 |
| 45 | n-butane | 32.1 | | 0.0 | | 0.0 | 67.9 |
| 46 | n-butane | 27.1 | | 0.0 | | 0.0 | 72.9 |

Next, fuel blends can be prepared by combining the isobutanol fuel blending compositions and CARBOB (CARBOB E10) using standard methods known in the art and described herein. Table 7 provides the Reid vapor pressure (Rvp) in units of pound-force per square inch (psi) for the CARBOB (CARBOB Rvp), the percentage by volume of isobutanol blending composition that is combined with the CARBOB to produce the fuel blend (% iBuOH blending composition in fuel), and the percentage by volume of isobutanol in the final fuel blend (% iBuOH in fuel blend).

TABLE 7

Compositions and performance parameters of fuel blends containing CARBOB and isobutanol fuel blending compositions

| Fuel | CARBOB | | % iBuOH blending composition | % iBuOH in fuel | Performance parameters | | | | Volatility | Rvp |
|---|---|---|---|---|---|---|---|---|---|---|
| Blend | Rvp | Type | in fuel | blend | RON | MON | Rvp | LBDI | Class | max |
| 36 | 5.9 | CARBOB E10 | 19.5 | 16.0 | 91.0 | 83.0 | 7.2 | 1163 | CA-2 | 7.2 |
| 37 | 5.9 | CARBOB E10 | 24.2 | 22.0 | 91.7 | 83.2 | 7.2 | 1213 | CA-2 | 7.2 |
| 38 | 5.9 | CARBOB E10 | 36.0 | 30.0 | 93.4 | 84.1 | 7.2 | 1248 | CA-2 | 7.2 |
| 39 | 5.9 | CARBOB E10 | 37.3 | 30.0 | 92.8 | 83.6 | 7.2 | 1248 | CA-2 | 7.2 |
| 40 | 5.7 | CARBOB E10 | 19.4 | 16.0 | 91.1 | 82.9 | 7.2 | 1155 | CA-2 | 7.2 |
| 41 | 5.7 | CARBOB E10 | 24.6 | 22.0 | 92.0 | 83.2 | 7.2 | 1203 | CA-2 | 7.2 |
| 42 | 10.1 | CARBOB E10 | 24.4 | 16.0 | 92.1 | 83.4 | 13.5 | 1057 | D-4 | 13.5 |
| 43 | 10.1 | CARBOB E10 | 30.6 | 22.0 | 93.2 | 83.8 | 13.4 | 1098 | D-4 | 13.5 |
| 44 | 10.1 | CARBOB E10 | 39.5 | 30.0 | 94.8 | 84.5 | 13.5 | 1135 | D-4 | 13.5 |
| 45 | 10.5 | CARBOB E10 | 23.6 | 16.0 | 91.6 | 83.1 | 13.4 | 1052 | D-4 | 13.5 |
| 46 | 10.5 | CARBOB E10 | 30.2 | 22.0 | 92.8 | 83.6 | 13.5 | 1090 | D-4 | 13.5 |

The research octane number (RON), motor octane number (MON), Rvp, and low-butanol driveability index (LBDI) for each fuel can be tested using industry standard methods or as described herein and provided in Table 7. The corresponding volatility class and the maximum Rvp for that class are also provided in Table 7.

Example 6

Performance Parameters of Fuel Blends Containing Isobutanol Fuel Blending Compositions and rBOB Ten rBOB fuel blends with isobutanol concentrations ranging from 22 vol % to 34 vol % can be tested for volatility properties and performance using industry standard methods (for example, ASTM D-4814 and LBDI as described herein).

First, isobutanol compositions for fuel blending can be prepared by combining isobutanol (iBuOH), a vapor pressure adjustment component, and optionally, an octane improving component and/or a driveability component using standard methods known in the art and described herein. Table 8 provides the percentage by volume ("%") of isobutanol, vapor pressure adjustment component, and optional octane improving component and/or driveability component for the isobutanol fuel blending compositions:

TABLE 8

Isobutanol compositions for fuel blending with rBOB

| Fuel Blending | Vapor pressure adjustment component | | Octane improving component | | Driveability component | | iBuOH |
|---|---|---|---|---|---|---|---|
| Composition | Material | % | Material | % | Material | % | % |
| 47 | n-butane | 6.5 | toluene | 13.8 | | 0.0 | 79.7 |
| 48 | n-butane | 8.3 | toluene | 13.3 | | 0.0 | 78.3 |
| 49 | n-butane | 6.1 | | 0.0 | isomerate | 3.2 | 90.7 |
| 50 | n-butane | 7.7 | toluene | 19.7 | isomerate | 2.5 | 70.2 |
| 51 | n-butane | 2.7 | toluene | 8.9 | isomerate | 20.6 | 67.9 |
| 52 | n-butane | 5.6 | toluene | 8.3 | isomerate | 5.6 | 80.5 |
| 53 | n-butane | 4.2 | toluene | 1.9 | isomerate | 11.2 | 82.7 |
| 54 | n-butane | 7.2 | toluene | 24.8 | isomerate | 4.5 | 63.5 |
| 55 | n-butane | 2.7 | toluene | 12.7 | isomerate | 20.9 | 63.8 |
| 56 | n-butane | 1.9 | toluene | 8.6 | isomerate | 23.2 | 66.3 |

Next, fuel blends can be prepared by combining the isobutanol fuel blending compositions and rBOB (ULR E15, Premium E15, ULR E20, or Premium E20) using standard methods known in the art and described herein. Table 9 provides the Reid vapor pressure (Rvp) in units of pound-force per square inch (psi) for the rBOB (rBOB Rvp), the percentage by volume of isobutanol blending composition that is combined with the rBOB to produce the fuel blend (% iBuOH blending composition in fuel), and the percentage by volume of isobutanol in the final fuel blend (% iBuOH in fuel blend).

TABLE 9

Compositions and performance parameters of fuel blends containing rBOB and isobutanol fuel blending compositions

| Fuel | rBOB | | % iBuOH blending composition | % iBuOH in fuel | Performance parameters | | | | Volatility | Rvp |
|---|---|---|---|---|---|---|---|---|---|---|
| Blend | Rvp | Type | in fuel | blend | RON | MON | Rvp | LBDI | Class | max |
| 47 | 4.8 | ULR E15 | 27.6 | 22 | 92.3 | 81.8 | 6.0 | 1205 | 6psi-2 | 6.0 |
| 48 | 5.8 | ULR E15 | 28.1 | 22 | 92.3 | 81.8 | 7.0 | 1199 | 7psi-2 | 7.0 |
| 49 | 5.8 | ULR E15 | 33.1 | 30 | 92.5 | 81.6 | 7.0 | 1246 | 7psi-2 | 7.0 |
| 50 | 5.8 | Premium E15 | 31.4 | 22 | 98.7 | 87.3 | 7.0 | 1249 | 7psi-2 | 7.0 |
| 51 | 5.8 | Premium E15 | 44.2 | 30 | 98.8 | 87.3 | 7.0 | 1249 | 7psi-2 | 7.0 |
| 52 | 5.8 | ULR E20 | 37.3 | 30 | 92.6 | 81.5 | 7.0 | 1246 | 7psi-2 | 7.0 |
| 53 | 5.8 | ULR E20 | 41.1 | 34 | 92.6 | 81.4 | 7.0 | 1244 | 7psi-2 | 7.0 |
| 54 | 5.8 | Premium E20 | 34.6 | 22 | 98.5 | 87.5 | 7.0 | 1248 | 7psi-2 | 7.0 |
| 55 | 5.8 | Premium E20 | 47.0 | 30 | 98.6 | 87.4 | 7.0 | 1245 | 7psi-2 | 7.0 |
| 56 | 5.8 | Premium E20 | 51.3 | 34 | 98.7 | 87.4 | 7.0 | 1244 | 7psi-2 | 7.0 |

The research octane number (RON), motor octane number (MON), Rvp, and low-butanol driveability index (LBDI) for each fuel were tested using industry standard methods or as described herein and provided in Table 9. The corresponding volatility class and the maximum Rvp for that class are also provided in Table 9.

What is claimed is:

1. A composition for fuel blending, comprising:

(i) isobutanol, wherein the isobutanol is present in a concentration from about 0.01 vol. % to about 99 vol. % based on a total volume of the composition;

(ii) an octane improving component wherein the octane improving component is selected from the group consisting of high-octane aromatics, high-octane isoparaffins, alkylate, reformate, and combinations thereof; and (iii) a vapor pressure adjustment component wherein the vapor pressure adjustment component is selected from the group consisting of n-butane, iso-butane, n-pentane, iso-pentane, mixed butanes, mixed pentanes, and combinations thereof.

2. The composition of claim 1, wherein the isobutanol is present in a concentration from about 0.1 vol. % to about 10 vol. % based on a total volume of the composition.

3. The composition of claim 1, wherein the isobutanol is present in a concentration from about 0.5 vol. % to about 10 vol. % based on a total volume of the composition.

4. The composition of claim 1, wherein the isobutanol is present in a concentration from about 1 vol. % to about 5 vol. % based on a total volume of the composition.

5. The composition of claim 1, wherein the octane improving component is present in a concentration from about 1 vol. % to about 50 vol. % based on a total volume of the composition.

6. The composition of claim 1, wherein the octane improving component is present in a concentration from about 5 vol. % to about 35 vol. % based on a total volume of the composition.

7. The composition of claim 1, wherein the vapor pressure adjustment component is present in a concentration from about 1 vol. % to about 30 vol. % based on a total volume of the composition.

8. The composition of claim 1, wherein the composition is for blending with a gasoline or blendstock for oxygenate blending (BOB), for terminal blending with a gasoline or BOB, or for splash-blending with a gasoline or BOB.

9. A fuel blend comprising:

(i) isobutanol, wherein the isobutanol is present in a concentration from about 0.01 vol. % to about 99 vol. % based on a total volume of the composition;

(ii) an octane improving component wherein the octane improving component is selected from the group consisting of high-octane aromatics, high-octane isoparaffins, alkylate, reformate, and combinations thereof;

(iii) a vapor pressure adjustment component wherein the vapor pressure adjustment component is selected from the group consisting of n-butane, iso-butane, n-pentane, iso-pentane, mixed butanes, mixed pentanes, and combinations thereof; and (iv) gasoline, a gasoline blend stock, or mixtures thereof.

10. The fuel blend of claim 9, wherein the concentration of isobutanol is from about 0.1 vol. % to about 10 vol. % based on a total volume of the fuel blend.

11. The fuel blend of claim 9, wherein the isobutanol is present in a concentration from about 0.5 vol. % to about 10 vol. % based on a total volume of the fuel blend.

12. The fuel blend of claim 9, wherein the isobutanol is present in a concentration from about 1 vol. % to about 5 vol. % based on a total volume of the fuel blend.

13. The fuel blend of claim 9, wherein gasoline is conventional gasoline, oxygenated gasoline, reformulated gasoline, biogasoline, Fischer-Tropsch gasoline, or combination thereof.

14. The fuel blend of claim 9, wherein the concentration of gasoline or gasoline blend stock is from about 1 vol. % to about 99 vol. % based on a total volume of the fuel blend.

15. The fuel blend of claim 9, wherein the gasoline, gasoline blend stock, or mixtures thereof is formulated for the addition of ethanol.

16. The fuel blend of claim 15, wherein the gasoline, gasoline blend stock, or mixtures thereof is formulated for the addition of at least 10% ethanol.

* * * * *